US009353500B1

(12) United States Patent
Andreski

(10) Patent No.: US 9,353,500 B1
(45) Date of Patent: May 31, 2016

(54) EXCAVATOR THUMB HAVING HARDENED REMOVABLE TEETH DEFINING A PLATFORM BEYOND A WEAR AND TEAR SURFACE OF THUMB

(71) Applicant: Cold Stone Shorelines And Retaining Walls, Inc., Marine on St. Croix, MN (US)

(72) Inventor: Benjamin David Andreski, Marine on St. Croix, MN (US)

( * ) Notice: Subject to any disclaimer, the term of this patent is extended or adjusted under 35 U.S.C. 154(b) by 438 days.

(21) Appl. No.: 13/680,003

(22) Filed: Nov. 16, 2012

Related U.S. Application Data

(60) Provisional application No. 61/718,949, filed on Oct. 26, 2012.

(51) Int. Cl.
*E02F 3/413* (2006.01)
*E02F 3/40* (2006.01)

(52) U.S. Cl.
CPC *E02F 3/413* (2013.01); *E02F 3/404* (2013.01)

(58) Field of Classification Search
CPC ..... E02F 3/404; E02F 3/413; E02F 3/4131; E02F 3/4133; E02F 3/4135; E02F 3/4136
USPC ..... 37/404, 406, 903; 414/722, 723, 724, 414/729, 739, 741
See application file for complete search history.

(56) References Cited

U.S. PATENT DOCUMENTS

| | | | | |
|---|---|---|---|---|
| 1,545,621 | A * | 7/1925 | Turner | 37/446 |
| 3,273,729 | A | 9/1966 | Holopainen | |
| 4,459,768 | A | 7/1984 | Albrecht | |
| 5,062,227 | A | 11/1991 | De Gier et al. | |
| 5,324,098 | A | 6/1994 | Massa et al. | |
| 5,533,682 | A | 7/1996 | de Gier et al. | |
| 6,612,051 | B2 | 9/2003 | Weyer et al. | |
| 7,037,064 | B2 | 5/2006 | Heiple | |
| 7,240,441 | B2 | 7/2007 | McCoy | |
| 7,533,481 | B2 | 5/2009 | McCoy | |
| 7,984,576 | B2 | 7/2011 | Miller et al. | |
| 8,201,350 | B2 | 6/2012 | Folkerts et al. | |
| 2005/0188568 | A1 * | 9/2005 | Clapper, Jr. | 37/406 |
| 2005/0193599 | A1 | 9/2005 | McCoy | |
| 2009/0077840 | A1 * | 3/2009 | Zeno et al. | 37/468 |

(Continued)

FOREIGN PATENT DOCUMENTS

| | | | |
|---|---|---|---|
| JP | 2012-41165 | A | 3/2012 |
| WO | 2011156099 | A2 | 12/2011 |

OTHER PUBLICATIONS

Genesis, Demolition Recycler, advertising flyer, Copyright 2012, Genesis, Superior, Wisconsin, U.S.A.

(Continued)

*Primary Examiner* — Ernesto Suarez
*Assistant Examiner* — Brendan Tighe

(57) ABSTRACT

A thumb for a hydraulic excavator having a boom, stick and bucket. The bucket pivots on a bucket axis. The thumb pivots on a thumb axis on or parallel to the bucket axis on which the bucket swings. The thumb swings to and away from the bucket to pick up and carry massive objects. Teeth having hardened tips are arranged proximally and distally along the length of the thumb and define a platform spaced from a wear and tear surface of the thumb to save frame components of the thumb from wear and tear and to better engage the massive objects.

8 Claims, 7 Drawing Sheets

(56) References Cited

U.S. PATENT DOCUMENTS

| | | | | |
|---|---|---|---|---|
| 2010/0058622 | A1* | 3/2010 | Calvert et al. | 37/405 |
| 2011/0225829 | A1 | 9/2011 | Raihala | |
| 2012/0151808 | A1* | 6/2012 | Seda et al. | 37/406 |
| 2013/0042507 | A1* | 2/2013 | Seda et al. | 37/406 |
| 2013/0115038 | A1* | 5/2013 | Bargellini et al. | 414/724 |

OTHER PUBLICATIONS

Ecavatorsupplydotcom, Excavator Thumbs, print out of website, five pages, Aug. 27, 2012, U.S.A.

* cited by examiner

EXCAVATOR THUMB HAVING HARDENED REMOVABLE TEETH DEFINING A PLATFORM BEYOND A WEAR AND TEAR SURFACE OF THUMB

FIELD OF THE INVENTION

The present invention generally relates to a thumb for a hydraulic excavator and more specifically to a thumb having hardened removable teeth that define a platform spaced from a wear and tear surface of the thumb.

BACKGROUND OF THE INVENTION

A boulder is a massive object that may be used for decoration in, for example, a front lawn of a residence. Like sized boulders, or stone blocks, may line a shoreline to minimize erosion. Massive rocks pose challenges to safety simply because of their weight.

As well as being massive, rocks are found in a variety of shapes. Some, like certain boulders, are egg shaped. Some, like stone blocks, are parallelepiped. The unique shape of a rock may render the rock relatively easy or difficult to manipulate between a thumb and a bucket.

Even if having a mass or shape that may pose few issues, rocks are carried from point to point over different terrain. A hydraulic excavator carrying a massive rock may have a flat easy route such as a driveway and sidewalk over which to carry the boulder or may encounter a tortuous undefined path in carrying the boulder to its final resting place on a shoreline.

Another feature of a boulder or stone block is its degree of hardness. For example, a granite block having quartz as part of its composition ranks high on the hardness scale. Blocks or boulders of such hardness, or of lesser hardness over a period of time, can significantly damage the frame of a thumb, even if the frame of the thumb is formed of hardened steel.

SUMMARY OF THE INVENTION

A feature of the present invention is a thumb for an excavator having a boom, stick and bucket.

Another feature of the present invention is the provision in a thumb for an excavator, of a thumb frame having a proximal end pivotally or fixedly engaged to an excavator train along a lateral axis, a distal end, a stick opposing face drawable in a direction to and away from the stick, and a bucket opposing face drawable in a direction to and away from the bucket.

Another feature of the present invention is the provision in a thumb for an excavator, of a platform that is spaced from the bucket opposing face and is between the bucket opposing face and the bucket, where the platform is at least partially defined by at least three hardened tips of respective teeth that are engaged to the thumb frame to offer the possibility of the hardened tips instead of the bucket opposing face engaging a massive object to save the thumb frame from wear and tear otherwise caused by the massive object.

Another feature of the present invention is the provision in a thumb for an excavator, of one of i) said hardened tip of said tooth and ii) said tooth as a whole being individually removable from said thumb frame.

Another feature of the present invention is the provision in a thumb for an excavator, of at least three hardened tips of respective teeth that are engaged to the thumb frame, where the at least three hardened tips define a plane.

Another feature of the present invention is the provision in a thumb for an excavator, of the bucket opposing face being formed of a material having a first degree of hardness, of at least three hardened tips of respective teeth that define a plane and have a second degree of hardness, and of the second degree of hardness being greater than the first degree of hardness.

Another feature of the present invention is the provision in a thumb for an excavator, of the platform being at least partially defined by at least four hardened tips, where the at least four hardened tips define a plane.

Another feature of the present invention is the provision in a thumb for an excavator, of the platform at least partially defined by three hardened tips and of a plane at least partially defined by three hardened tips, and of the platform and plane being coplanar.

Another feature of the present invention is the provision in a thumb for an excavator, of the thumb frame having a longitudinal length defined by a direction from the proximal end of the thumb frame to the distal end of the thumb frame, of the proximal end extending one-half the longitudinal length of the thumb frame, of the distal end extending one-half the length of the thumb frame, and of a platform being defined by at least three hardened tips and extending over at least a portion of the proximal end and further extending over at least a portion of the distal end.

Another feature of the present invention is the provision in a thumb for an excavator, of the thumb frame having a longitudinal length defined by a direction from the proximal end of the thumb frame to the distal end of the thumb frame, of the proximal end extending one-half the longitudinal length of the thumb frame, of the distal end extending one-half the length of the thumb frame, of at least one of three hardened tips extending from the proximal end of the thumb frame, and at least one of the three hardened tips extending from the distal end of the thumb frame.

Another feature of the present invention is the provision in a thumb for an excavator, of the bucket opposing face having a longitudinally running planar face, of a platform being a planar platform running parallel to the longitudinally running planar face and at least three hardened tips at least partially defining the planar platform.

Another feature of the present invention is the provision in a thumb for an excavator, of the bucket opposing face having a longitudinally running concave face, of a concave platform running parallel to the longitudinally running concave face and at least three hardened tips at least partially defining the concave platform.

Another feature of the present invention is the provision in a thumb for an excavator, of the thumb frame having at least three hardened tips, and of at least two hardened tips of the at least three hardened tips defining a straight line that runs nonparallel to the lateral axis about which the thumb frame pivots.

Another feature of the present invention is the provision in a thumb for an excavator, of the thumb frame having at least three hardened tips, of at least two hardened tips of the at least three hardened tips defining a straight line, and of the straight line intersecting a line extending in a lateral direction that is parallel to the lateral axis about which the thumb frame pivots.

Another feature of the present invention is the provision in a thumb for an excavator, of the thumb frame having at least three hardened tips, of at least two hardened tips of the at least three hardened tips defining a straight line, and of the straight line running normal to a line extending in a lateral direction that is parallel to the lateral axis about which the thumb frame pivots.

Another feature of the present invention is the provision in a thumb for an excavator, of a tooth receptacle between each of the teeth and the thumb frame, of the tooth receptacle having a through opening extending in a direction from the stick opposing face of the thumb frame to the bucket opposing face of the thumb frame, of the opening receiving a tooth of one of the teeth, of the tooth having an end opposite of said hardened tip, and of the end of the tooth being accessible through the opening such that the tooth can be punched out of the tooth receptacle in the direction from the stick opposing face of the thumb frame to the bucket opposing face of the thumb frame.

Another feature of the present invention is the provision in a thumb for an excavator, of each of the teeth being individually removable from the thumb frame.

Another feature of the present invention is the provision in a thumb for an excavator, of the hardened tip being removable from the remainder of the body of the tooth such that each of the hardened tips is individually removable from each of the other hardened tips.

Another feature of the present invention is the provision in a thumb for a hydraulic excavator, of each of the teeth including a hardened tip and a body, of the hardened tip having a first hardness, of the body having a second hardness, and of the first hardness having a degree of hardness greater than the second hardness.

An advantage of the present invention is safety in relation to handling of boulders of unique shapes, sizes and composition. A uniquely shaped massive rock may be relatively difficult to pick up and carry. An extremely large boulder may also be relatively difficult to pick up and carry. A rock having a brittle composition may break as it is being picked up or carried. A rock with a smooth surface may be relatively slippery and thus relatively difficult to pick up and carry. With the provision of proximal and distal teeth, the chances of safely handling a massive rock are maximized.

Another advantage of the present invention is safety in relation to wear and tear on the bucket opposing surfaces of the thumb. Such wear and tear comes about as the thumb and bucket, acting as opposing jaws, pick up and carry massive boulders. The hydraulics of the hydraulic excavator can exert relatively great forces on the rocks through the thumb and bucket. As a result, even hardened steel is worn and torn and thus weakened. By providing a platform of hardened tips where the platform is spaced from the bucket opposing face, or by providing a plane of hardened tips where the plane is spaced from the bucket opposing face, wear and tear on the bucket opposing face is minimized.

Another advantage of the present invention is cost. A thumb formed of steel such as hardened steel is relatively expensive, whereas a hardened tip or a tooth having a hardened tip is relatively inexpensive. The provision of independently removable teeth or hardened tips minimizes cost because less thumbs need to be replaced.

Another advantage of the present invention is conservation of material. While worn and torn thumbs may be recycled, there is no guarantee that the end user will recycle a worn and torn thumb.

Another advantage of the present invention is efficiency. With a thumb having proximal and distal teeth, massive rocks may be picked up more quickly, saving the operator of the hydraulic excavator time and effort.

Another advantage of the present invention is aesthetics. With proximal and distal teeth picking up a massive rock at a limited number of locations that have hardened tips, the rock is less likely to slip and scratches and markings made by the hardened tips are minimized when the rock is deposited in its final resting place along the shoreline or in the front yard of a residence. With a nontoothed thumb picking up a rock along a relatively great surface area, markings left by the thumb are maximized.

DETAILED DESCRIPTION

Figure 1:
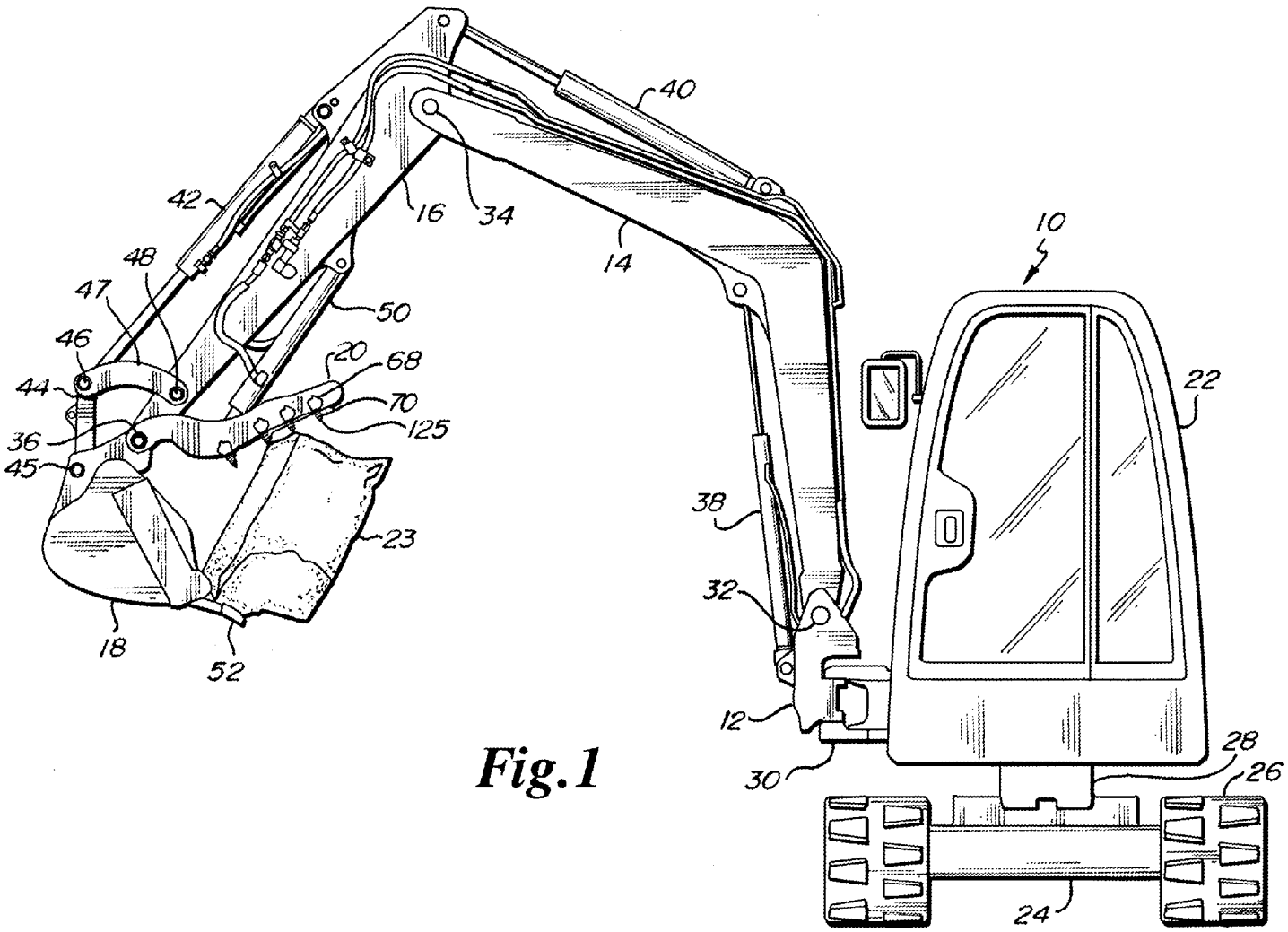
FIG. 1 is a side view of the present thumb and an excavator, where the thumb is engaged to and manipulated by the train of the excavator, where the train includes a kingpost, boom, stick, bucket and the associated hydraulics.

FIG. 1 shows a backhoe or hydraulic excavator 10. Hydraulic excavator 10 includes, as part of an excavator train, a kingpost 12, a boom 14, a stick, dipper or dipper-stick 16, a digging bucket 18, and the present thumb 20. The kingpost 12 is engaged to a rotating platform or a house or cab 22. House 22 is pivotally engaged to an undercarriage 24 having a pair of tracks 26. The house 22 may be stabilized by horizontal stabilizers extending from the house 22 to the ground. A massive stone block 23 is being lifted and carried by the pinching action between thumb 20, acting as one jaw, and bucket 18, acting as another jaw.

The house 22 can pivot or articulate relative to the undercarriage 24 through a pivot or junction 28 that engages the house 22 to the undercarriage 24. The junction 28 permits the house 22 to pivot 360 degrees relative to the undercarriage 24.

Junction 28 has a vertical axis or an axis normal to axles on which the tracks 26 ride. Junction 28 permits house 22 to rotate.

The kingpost 12 can pivot or articulate relative to the house 22 through a pivot or junction 30 that engages the kingpost 12 to the house 22. Junction 30 permits the kingpost 12 to pivot or articulate relative to the house 22 for more than 180 degrees or more than 200 degrees. Junction 30 has a vertical axis or an axis that is parallel to the axis of junction 28. Junction 30 permits a side to side movement of the kingpost 12.

The boom 14 can pivot or articulate relative to the kingpost 12 through a pivot or junction 32 that engages the boom 14 to the kingpost 12. Junction 32 has a horizontal axis or an axis that is normal to the axis of the kingpost junction 30. Junction 32 permits the boom 14 to move up and down. Junction 32 permits the boom 14 to move to and away from the house 22.

The stick 16 can pivot or articulate relative to the boom 14 through a pivot or junction 34 that engages the stick 16 to the boom 14. Junction 34 has a horizontal axis or an axis that is parallel to the boom junction 32. Junction 34 permits the stick 16 to move up and down relative to the boom 14. Junction 34 permits the stick 16, particularly the distal end of the stick 16, to move to and away from the boom 14.

The bucket 18 can pivot or articulate relative to the stick 16 through a pivot or junction 36. Junction 36 has a horizontal axis or an axis that is parallel to stick/boom junction 34. Junction 36 permits bucket 18 to pivot up and down relative to the stick 16. Junction 36 permits the bucket 18, particularly the distal end of the bucket 18, to move to and away from the stick 16.

The thumb 20 can pivot or articulate relative to the stick 16 through the pivot or junction 36. Junction 36 permits the thumb 20 to move up and down relative to the stick 16. Junction 36 permits the thumb 20, particularly the distal end of the thumb 20, to move to and away from the stick 16 or to be drawn to and drawn away from the stick 16. Junction 36 defines a lateral axis of the thumb 20 and a lateral axis of the bucket 18.

The thumb 20 can pivot or articulate relative to the bucket 18 through the pivot or junction 36. Junction 36 permits the thumb 20 to move up and down relative to the bucket 18. Junction 36 permits the thumb 20, particularly the distal end of the thumb 20, to move to and away from the bucket 18 or to be drawn to and drawn away from the bucket 18.

A hydraulic cylinder or linear actuator 38 mounted between the kingpost 12 and the boom 14 extends and retracts to pivot the boom 14 about the pivot 32. A proximal end of the cylinder of the linear actuator 38 is pivotally affixed to the kingpost 12. A distal end of the piston of the linear actuator 38 is pivotally affixed to the boom 14.

A hydraulic cylinder or linear actuator 40 mounted between the boom 14 and the stick 16 extends and retracts to pivot the stick 16 about the pivot 34. A proximal end of the cylinder of the linear actuator 40 is pivotally affixed to the boom 14. A distal end of the piston of the linear actuator 40 is pivotally affixed to the stick 16.

A hydraulic cylinder or linear actuator 42 mounted between the stick 16 and the bucket 18 extends and retracts to pivot the bucket 18 about the pivot 36. A proximal end of the cylinder of the linear actuator 42 is pivotally affixed to the stick 16. A distal end of the piston of the linear actuator 42 is pivotally affixed to the bucket 18. More specifically, the distal end of the piston of linear actuator 42 is pivotally engaged to a linkage portion 44 at a pivot 46. Linkage portion 44 is rigidly affixed to bucket 18 at junction 45. Another linkage portion 47, shaped like an arc or segment of a circle, is pivotally engaged between linkage portion 44 through pivot 46 and a second pivot 48. One end of linkage portion 47 is pivotally engaged to linkage portion 44 through pivot 46. The other end of linkage portion 47 is pivotally engaged to a distal end portion of stick 16 through pivot 48.

A hydraulic cylinder or linear actuator 50 mounted between stick 16 and thumb 20 extends and retracts to pivot thumb 20 about the pivot 36. A proximal end of the cylinder of the linear actuator 50 is pivotally affixed to the stick 16. A distal end of the piston of the linear actuator 50 is pivotally affixed to the thumb 20.

Figure 2B:
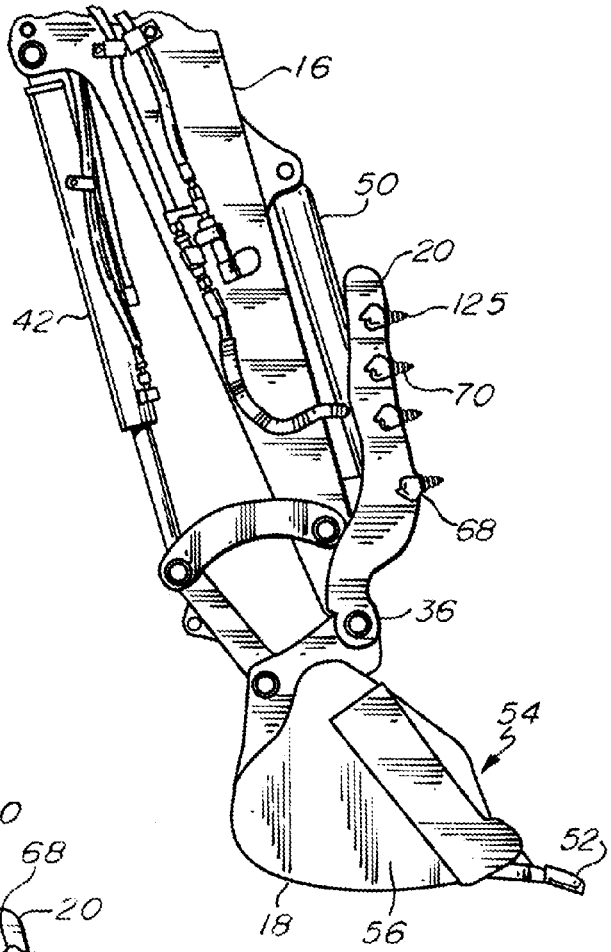
FIG. 2B is a side view of the thumb of FIG. 1 in a drawn back position relative to a turned down bucket.
Figure 2A:
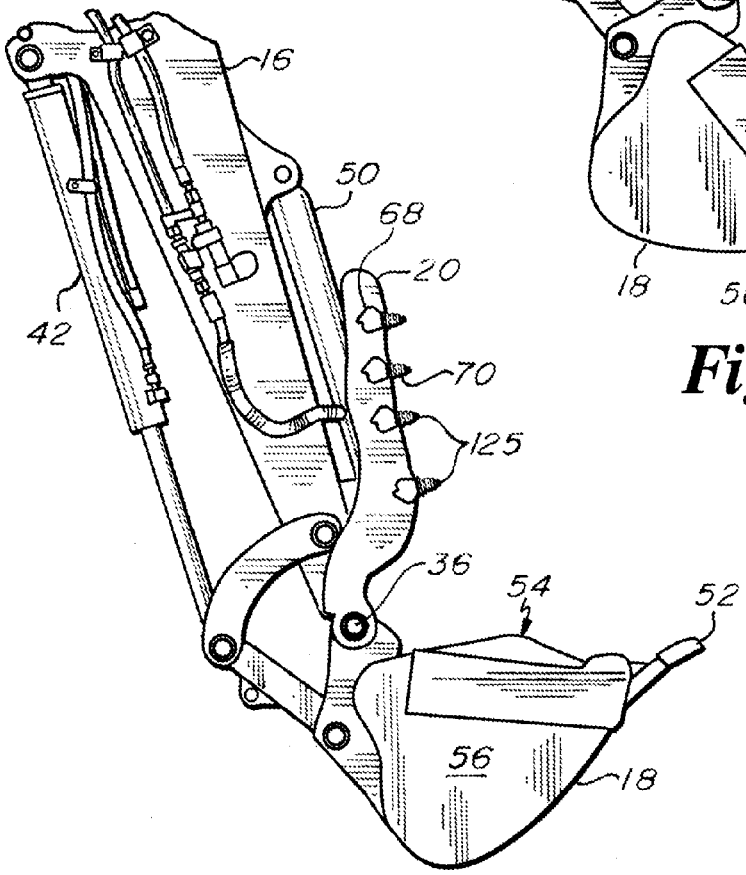
FIG. 2A is a side view of the thumb of FIG. 1 in a drawn back position relative to a turned up bucket.
Figure 3B:
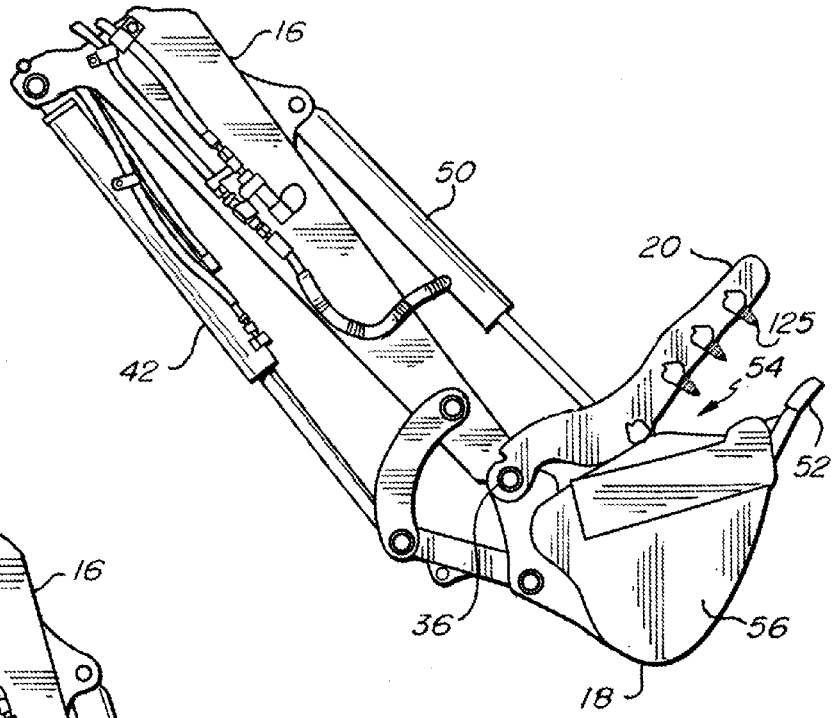
FIG. 3B is a side view of the thumb of FIG. 1 in a pushed forward position relative to a turned up bucket.
Figure 3A:
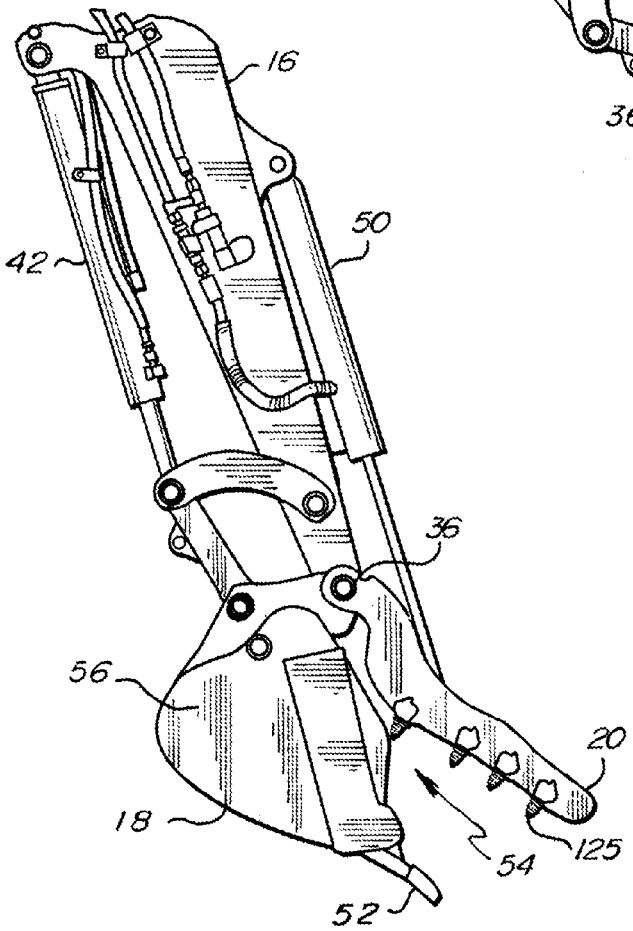
FIG. 3A is a side view of the thumb of FIG. 1 in a pushed forward position relative to a turned down bucket.

FIGS. 2A, 2B, 3A and 3B show the positions of the thumb 20 relative to the stick 16. In FIGS. 2A and 2B, the piston of the linear actuator 50 is retracted into the cylinder of the linear actuator 50 such that the distal end of the thumb 20 confronts the stick 16. In FIG. 3A, the piston of the linear actuator 50 is extended such the distal end of the thumb 20 is positioned away from the stick 16 and almost 180 degrees away from the stick 16. In FIG. 3D, the piston of the linear actuator 50 is between fully extended and fully retracted positions and the thumb 20 lies generally at a right angle relative to the stick 16.

FIGS. 2A, 2B, 3A and 3B show the positions of the bucket 18 relative to the stick 16. First, it can be noted that the bucket 18 includes a distal digging end 52, one or more walls 56 such as side walls, front walls, bottom walls and rear walls, and an opening 54. Distal digging end 52 opposes a rear wall, side walls oppose each other, a front wall opposes a rear wall, and a bottom wall opposes the opening 54. FIGS. 2A and 3B show the piston of the linear actuator 42 extended to push the distal digging end 52 relatively closely to the stick 16. Here the opening 54 of bucket 18 is oriented generally vertically such that the bucket 18 may hold a fluid or fluid like material such as water, mud, loose soil or sand without the fluid or fluid like material running out of the bucket 18. FIGS. 2B and 3A show the piston of the linear actuator 42 retracted to draw the distal digging end 52 relatively far away from the stick 16. Here a fluid or fluid like material runs out of the bucket 18. FIG. 2B shows the bottom wall of bucket 18 and the distal digging end 52 on a generally horizontal surface such as the ground. FIG. 3A show the distal digging end 52 digging into the ground.

FIGS. 2A, 2B, 3A and 3B show the positions of the thumb 20 relative to the bucket 18. In FIG. 2A, the piston of the linear actuator 50 retracts the thumb 20 and the piston of the linear actuator 42 extends the bucket 18 such that the thumb 20 is positioned away from the opening 54 and distal digging end 52. Here the bucket 18 may hold fluid, or the bucket 18 may hold a massive rock, or the thumb 20 and distal digging end 52 may work like jaws to hold a massive rock therebetween with or without aid from the upper edges of any of the side, rear, or front walls of the bucket 18. In FIG. 2B, the piston of the linear actuator 42 is retracted and the piston of the linear actuator 50 is retracted to draw the distal end of the thumb 20 and distal digging end 52 away from each other. Here there is relatively great access to opening 54 and distal digging end 52 are positioned to, for example, be pushed under a rather massive rock, whereupon the piston of the linear actuator 50 can be extended to grab the massive rock between the thumb 20 and distal digging end 52. In FIG. 3A, the piston of linear actuator 42 is retracted and the piston of linear actuator 50 is extended to place the thumb 20 and distal digging end 52 into a confronting or adjacent or opposing relationship so as to close off opening 54, so as to grab relatively small boulders between thumb 20 and distal digging end 52. Here massive boulders may also be carried by the thumb 20 and distal digging end 52 by drawing one or more of the thumb 20 and distal digging end 52 away from the other. In FIG. 3B, the piston of linear actuator 42 is extended and the piston of the linear actuator 50 is in an intermediate position to place the thumb 20 and distal digging end 52 into a confronting or adjacent or opposing relationship so as to close off opening 54, so as to grab relatively small boulders between thumb 20 and distal digging end 52. Here massive boulders may also be carried by the thumb 20 and digging teeth by drawing one or more of the thumb 20 and distal digging end 52 away from the other.

FIGS. 2A, 2B, 3A and 3B further show the length of the thumb 20 relative to the bucket 18 where the length of the thumb 20 is defined by the distance from junction 36, at the proximal end of the thumb 20, to the distal end of the thumb 20. As shown in FIG. 3B, where the distal end of the thumb 20 is closer to the distal end of the bucket 18 than in any of the other FIGS. 2A, 2B, and 3A, the thumb 20 extends beyond the distal digging end 52 of the bucket 18. The most distal tooth will engage the distal digging end 52 of the bucket 18 when the thumb 20 is further pivoted toward the bucket 18. The thumb 20 may have a length that extends 50% to 150% over opening 54 and more preferably 75% to 125% over the length of the opening 54, where the opening 54 terminates at the most distal portion of the bucket 18 such as the distal tip of a tooth of the bucket 18.

From the above descriptions of FIGS. 2A, 2B, 3A and 3B, it can be appreciated that all of the following portions are available and accessible to the operator of the hydraulic excavator 10: a) the proximal end portion of the thumb 20, b) the proximal end portion of the bucket 18, c) the distal end portion of the thumb 20, d) the distal end portion of the bucket 18. The thumb 20 can be defined as having a longitudinal length. One-half of the length can be defined as being the proximal end or proximal end portion. The other one-half of the length can be defined as being the distal end or distal end portion. Even portions of the proximal end portion of the thumb 20 that are adjacent to or confront the junction 36 or lateral axis 36 can participate in picking up and carrying an object and can include tooth receptors 68, teeth 70 and hardened tips 125, as described below.

Figure 4A:
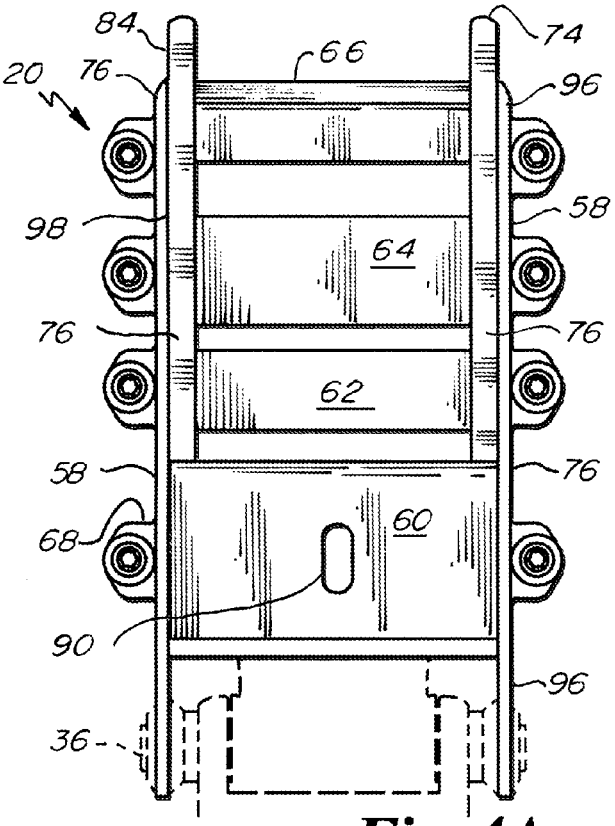
FIG. 4A is a front, detailed view of the thumb of FIG. 1.
Figure 4B:
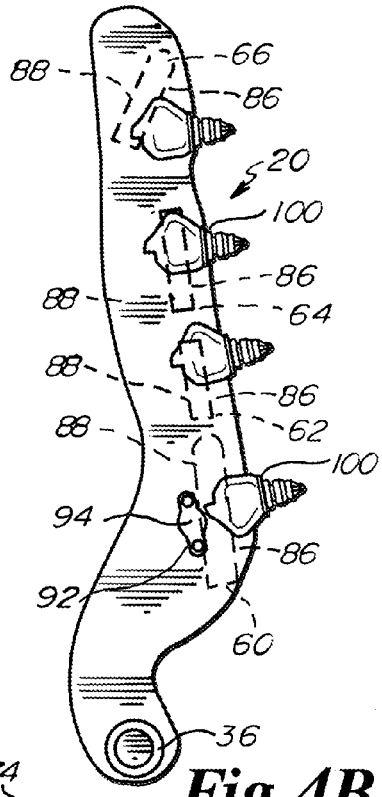
FIG. 4B is a side, partially phantom, detailed view of the thumb of FIG. 1.

FIGS. 4A, 4B, 4C and 4D show detail views of the preferred thumb 20. As shown in FIG. 4B, thumb 20 includes a pair of side support members 58, a first or proximal cross support member 60, a second or intermediate cross support member 62, a third or intermediate cross support member 64, and a fourth or distal cross support member 66, female tooth receptors 68, and replaceable teeth 70.

Side support member 58 includes a proximal end 72 that is engaged to junction 36 and a distal end 74 that is distal relative to junction 36. As described below, side support member 58 includes a longitudinally extending plate 96 and a longitudinal extending plate 98 that are welded to each other face to face.

Side support member 58 includes a bucket opposing edge 76 and a stick opposing edge 78. The bucket and stick opposing edges 76, 78 define, with other bucket and stick opposing elements of thumb 20, a bucket opposing face and a stick opposing face of the thumb 20. Bucket opposing edge 76 opposes the bucket 18 and stick opposing edge 78 opposes the stick 16.

Bounded by the bucket opposing edge 76 and the stick opposing edge 78, side support member 58 includes an outer side or face 80 to which the female tooth receptors 68 are welded and an inner side or face 82 to which the cross supports 60, 62, 64 and 66 are welded. The distance between outer and inner sides or faces 80, 82 define a thickness of side support member 58. Side support member 58 is relatively thin at the proximal end 72 and is relatively thick from cross support member 60 to cross support member 66, i.e., from a proximal edge of cross support member 60 to a distal cross edge of cross support member 66, where a tip or point section 84 of side support member 58 is relatively thin. Tip or point section 84 includes distal end 74.

The side support members 58 define a longitudinal direction. The cross support members 60, 62, 64, 66 define a lateral direction. The direction from bucket opposing edge 76 to stick opposing edge 78 of one side support member 58 defines a depth direction.

Side support member 58 and cross support members 60, 62, 64, 66 are formed of steel, preferably a hardened steel. Female tooth receptors 68 are formed of steel, preferably a hardened steel.

Each of the cross support members 60, 62, 64, 66 is welded to the inner sides or faces 82 of side support members 58 at a location adjacent to the bucket opposing edges 76 of side support members 58. Each of the cross support members 60, 62, 64, 66 includes a bucket opposing face 86 and a stick opposing face 88.

As shown in FIG. 4B, the outer ends of the bucket opposing face 86 are adjacent to their respective bucket opposing edges 76 of the side support members 58. This applies to each of cross support members 60, 62, 64, 66.

As further shown in FIG. 4B, the outer ends of the stick opposing face 88 are spaced from their respective stick opposing edges 78 of the side support members 58. This applies to each of cross support members 60, 62, 64, 66.

Each of the cross support members 60, 62, 64 lies closer to the bucket opposing face of the thumb 20 than the stick opposing face of the thumb 20.

The cross support members 60, 62, 64, 66 lie adjacent to the bucket opposing face of thumb 20.

Cross support member 66 also lies adjacent to the stick opposing face of thumb 20.

Each of the cross support members 60, 62, 64, 66 is shaped like a plank or plate such that their respective bucket opposing faces and stick opposing faces are relatively broad in the longitudinal and lateral directions and such that the depth or thickness of the cross support members, i.e., the distance between the respective bucket and stick opposing faces, is relatively small. Each of the bucket and stick opposing faces of each of the cross support members 60, 62, 64, 66 is rectangular in shape.

Each of the cross support members 60, 62, 64, 66 is spaced apart from an adjacent cross support member to provide a space therebetween. Member 60 is spaced apart from member 62. Member 62 is spaced apart from each of members 60 and 64. Member 64 is spaced apart from each of members 62 and 66. Member 66 is spaced apart from member 64. The spaces are through spaces and are elongate in the lateral direction. The spaces permit the operator of the thumb 20 to see through the thumb 20 and, at the same time, the cross support members 60, 62, 64, 66 provide 1) strength to the thumb 20 by tying the side support members 58 to each other, 2) a secondary platform for engaging boulders where the hardened tips 125 provide a primary platform for engaging boulders, and 3) a barrier such that boulders and other rigid massive bodies do not hit the linear actuator 50 or the stick 16.

Cross support members 62 and 64 are disposed in generally a common plane with each other. Distal cross support member 66 intersects this common plane but does not lie in this common plane. Distal cross support member 66 lies obliquely relative to this common plane. Distal cross support member 66 lies in its own plane, which plane is oblique to the common plane of cross support members 60, 62, 64. Oblique means neither perpendicular nor parallel. Oblique means an angle that is not a multiple of 90 degrees. The obliqueness of cross support member 66 may provide a number of functions, including the provision of a receptacle for a pointed end of a massive stone block, where such a receptacle is formed by the oblique bucket face of cross support member 66 in combination with the distal edge of cross support member 64. An apex or edge of the massive stone block may be engaged by such a receptacle and protrude into the space between distal cross member support 66 and its adjacent cross member support 64. The distal edge of distal oblique cross support member 66 lies relatively closely to a plane formed by bucket edges 76. The proximal edge of distal oblique cross support member 66 lies relatively closely to a plane formed by stick opposing edges 78.

Cross support member 60 may be disposed in a plane that lies generally parallel to, but offset from, the plane having cross support members 62, 64. The plane of cross support member 60 is disposed closer to the points of the teeth 70 than the common plane of cross support members 62, 64.

Proximal cross support member 60 includes an intermediate through opening 90 that is elongate in the longitudinal direction and that passes through the proximal cross support member 60 in the depth direction. Opening 90 is equidistance from each of side support members 58 and equidistance from each of the distal edge and proximal edge of cross support member 60. Opening 90 may be engaged by a portion of a distal connection 94 of the piston of linear actuator 50.

Figure 4C:
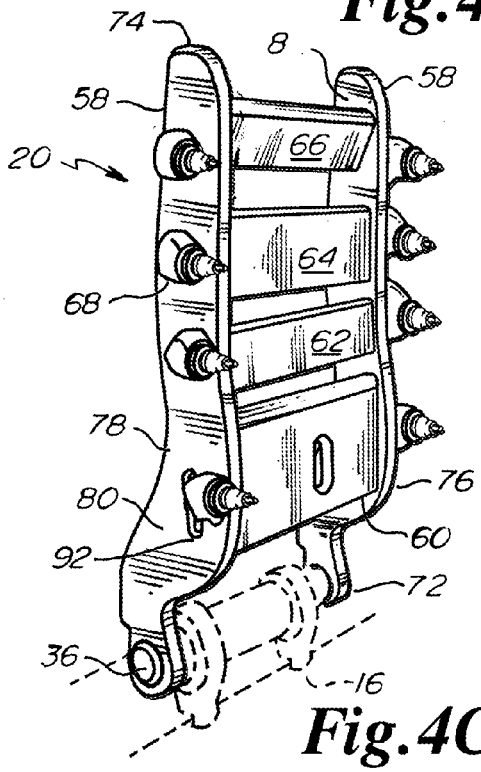
FIG. 4C is a perspective, detailed view of the thumb of FIG. 1.
Figure 4D:
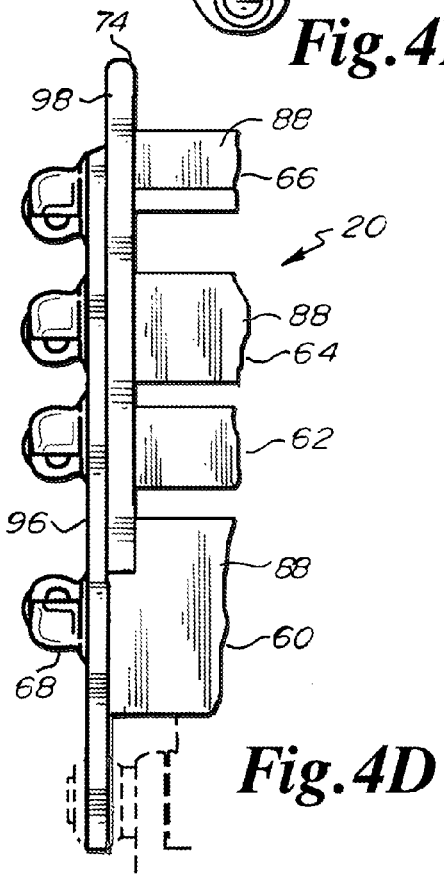
FIG. 4D is a rear, detailed view of the thumb of FIG. 1.

Side support member 58 includes a through opening 92 that is elongate in the longitudinal direction and passes through side support member 58 in the lateral direction. Through opening 92 is disposed between bucket opposing edge 76 and stick opposing edge 16 and is disposed immediately below a plane formed by the stick opposing face 88 of proximal cross support member 60. As shown in FIG. 4C, a distal connection 94 of the piston of linear actuator 50 is engaged in opening 92.

The distal connection 94 of the piston of the linear actuator 50 is engaged at a proximal, rather than distal, location on thumb 20. Cross support member 62 is located at a midpoint location between proximal end 72 and distal end 74. Openings 90 and 92 are between such midpoint location and proximal end 72.

Side support member 58 is formed from two pieces or plates. An outer plate 96 runs from junction 36 to a straight lateral line that is generally aligned with the distal most portion of the distal edge of cross support member 66. An inner plate 98 runs from distal end 74 to and beyond the distal edge of cross support member 60 and terminates at a location intermediate the distal and proximal edges of the cross support member 60.

After being welded face to face, outer and inner plates 96, 98 form, as one-piece, side support member 58. The bucket opposing edges of plate 96 and plate 98 form face or edge 76. The bucket opposing faces 86 of cross support members 60, 64, and 66 lie slightly inwardly of bucket opposing edge 76, i.e., slightly in the direction of the stick opposing edge 78.

Cross support members 62, 64, 66 are welded to and between the inner faces of inner plates 98. Cross support member 60 is welded to and between the inner faces of outer plates 96. Cross support member 60 is further welded to a bucket opposing edge of inner plate 98. Cross support plates 62 and 64 may be in a common plane. Cross support plate 60 may be outside of this common plane and may be disposed in a parallel plane that is set closer to the bucket opposing face of the thumb 20. The direction from stick opposing edge 78 to bucket opposing edge 76 defines a bucket direction or the "z" direction, where the lateral or cross direction is the "x" direction and where the longitudinal direction is the "y" direction.

The female tooth receptors 68 are welded to the outer sides or faces 80 of the side support members 58, specifically to the outer faces of the outer plates 96. Four tooth receptors 68 are mounted to the outside face of one outer plate 96 and four tooth receptors 68 are mounted to the outside face of the other outer plate 96. Each set of four teeth receptors 68 is centered on a straight line that runs perpendicular to a lateral straight line that runs parallel to lateral axis 36 and to a lateral straight line that runs parallel to a line defined by the tips of the bucket digging teeth 140, or by the bucket digging edge 142, of bucket 18. One pair of tooth receptors 68 opposes either end of cross support 60. Another pair of tooth receptors 68 opposes either end of cross support 62. Another pair of tooth receptors 68 opposes either end of cross support 64. Another pair of tooth receptors 68 opposes, and is slightly offset from, the distal cross support member 66.

Each of the tooth receptors 68 includes an upper end 100. The upper ends of the tooth receptors 68 that oppose cross support member 60 are disposed slightly beyond bucket opposing edge 76 of side support member 58. The upper ends of the tooth receptors 68 that oppose cross support members 62, 64, 66 are disposed generally in the plane of bucket opposing edge 76.

Figure 5A:
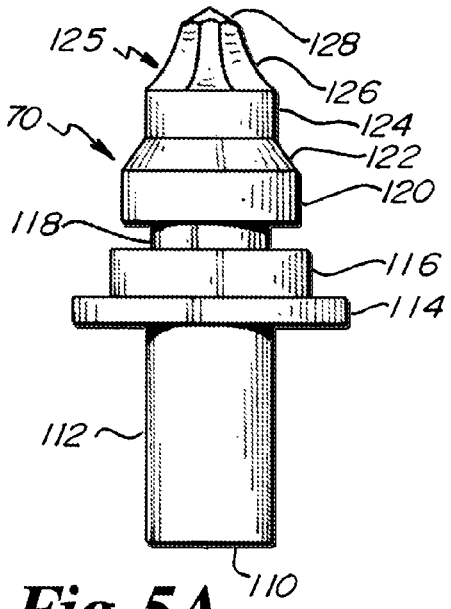
FIG. 5A is a side, detailed view of a tooth of the thumb of FIG. 1, with the tooth having a hardened tip.
Figure 5B:
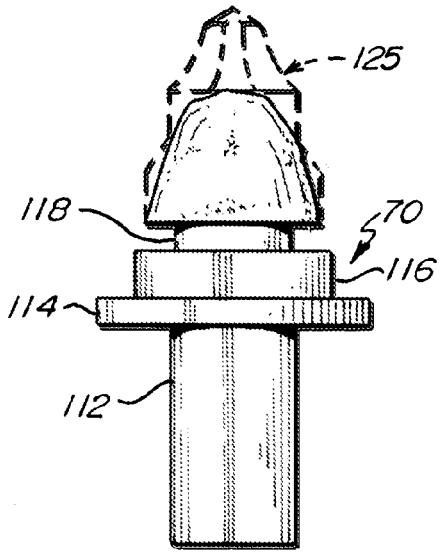
FIG. 5B is a detailed view of the tooth of FIG. 5A after the tooth has been utilized for some time on the thumb of FIG. 1.
Figure 5C:
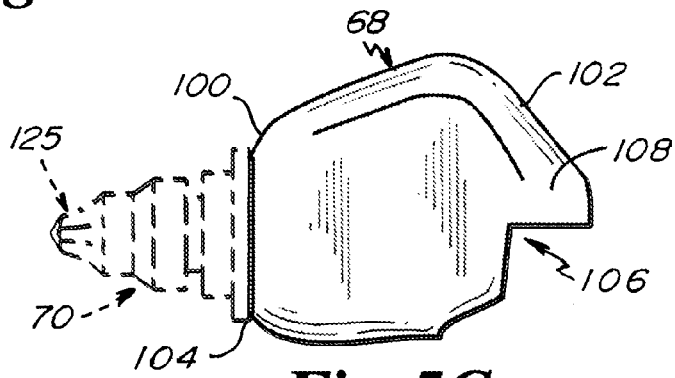
FIG. 5C is a side, detailed view of a tooth receptacle for the tooth of FIG. 5A and shows an upper portion of the tooth of FIG. 5A in phantom, where the receptacle is welded to the thumb shown in FIG. 1.
Figure 5D:
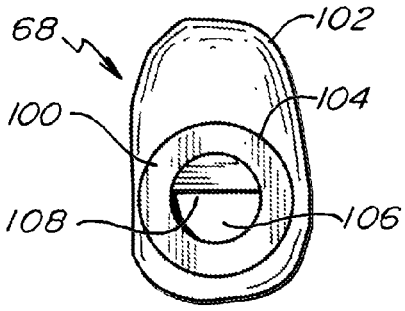
FIG. 5D is a top view of the tooth receptacle of FIG. 5C.

As shown in FIG. 5D, each of the tooth receptors 68 includes a body 102, an annular flat mount 104, an opening 106, and a stop 108. The upper end 100 includes the annular flat mount 104. The annular flat mount 104 defines the opening 106. Opening 106 is partially blocked off by stop 108. Stop 108 is integral and one-piece with body 102 and extends over about one-third to about one-half of the bottom of the opening 106.

Tooth 70 includes, in sequence, a bottom end 110, a first cylindrical portion 112, a second cylindrical portion 114, a third cylindrical portion 116, a fourth cylindrical portion 118, a fifth cylindrical portion 120, a frustoconical portion 122, a sixth cylindrical portion 124, and a hard tip 125. Hard tip 125 includes a tapering region 126 formed of six concave sections curving inwardly and away from the bottom 110, and an apex or conical region 128 tapering to a point.

Figure 5E:
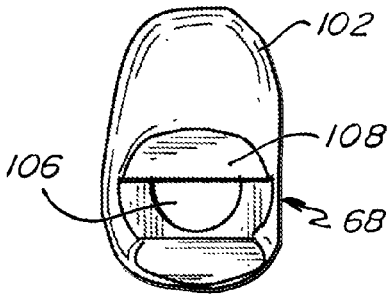
FIG. 5E is a bottom view of the tooth receptacle of FIG. 5E.

Cylindrical portion 112 has a diameter slightly larger than the diameter of hole 106 such that tooth 70 engages the receptor 68 through a friction fit. Cylindrical portion 112 can be pounded into receptor 68 with a hammer making contact with, for example, cylindrical portion 114, until the bottom end 100 hits the stop 108 or until the undersurface of the cylindrical portion 114 hits the annular mount 104. To remove the tooth 70 from the receptor 68, an elongate instrument or punch such as a chisel or screwdriver is inserted through the bottom of the opening 106, as shown in FIG. 5E, until an end of the punch hits the bottom end 100 of the tooth 70, and then the other end of the punch is hit with a hammer to push the tooth 70 out of the receptor 68. Cylindrical portion 112 can be made up of two parts.

Specifically, cylindrical portion 112 can include a retainer sleeve and an axially rearward end of the tool body or tooth body that fits into the retainer sleeve such that the tooth body is rotatable in the retainer sleeve and such that the hardened tip 125 is rotatable on an axis of the rotationally symmetrical tooth 70. The retainer sleeve is the section that frictionally engages the bore or hole 106 of receptor 68. The tooth body is a portion of tooth 70 that extends from within the retainer sleeve, such as at or adjacent to bottom end 110, axially forward to cylindrical portion 124.

Cylindrical portion 114 acts as a stop to prevent the tooth 70 from being pushed or pounded excessively far into receptor 68. Cylindrical portion 114 is a piece that can be separate from its adjacent portions 112 and 116. Cylindrical portion 114 may be in the nature of a washer that permits rotation of the tooth body relative to the receptor 68.

Cylindrical portions 116, 118, 120, 122, 124 are monolithic and are further monolithic with the portion of the tooth body within the retainer of cylindrical portion 112. Portion 116 has the greatest diameter. Portion 118 has a diameter slightly less than the diameter of portion 124. Portion 120 has a diameter greater than the diameters of portions 118 and 124 but less than the diameter of portion 116. Frustoconical portion 122 tapers from portion 120 to portion 124.

Portion 124 is the axially forward most end of the monolithic tooth body. The axially rearward most end of the monolithic tooth body is found in the retainer of cylindrical portion 112 at or adjacent to the bottom end 110 of the cylindrical portion 112. The tooth body may be formed of steel such as a hardened steel.

Cylindrical portion 124 can include a socket for receiving and mounting the hard tip 125. The hard tip 125 can be a cemented tungsten carbide that is a composite of tungsten carbide and cobalt. The cobalt content may range from about 5 to about 13 weight percent with the balance being tungsten carbide except for impurities. The hard tip 125 having a tungsten carbide grade containing about 5.4 to about 6.0 weight percent cobalt may have a Rockwell A hardness between about 88.2 and about 88.8. The hard tip 125 may be brazed to the monolithic tooth body.

On the Mohs scale of hardness, hardened tip 125 has a rating or value of 8.5-9.0. In contrast, the bucket opposing face 86, formed of hardened steel, has a rating or value on the Mohs scale of 7.0-8.0. Quartz, a mineral found in massive boulders such as in massive boulders formed of granite, has a rating or value on the Mohs scale of hardness of 7.0. Hardened tips 125 form a platform or plane of a first hardness spaced apart from the bucket opposing face 86 having a second hardness, where the first hardness has a greater hardness rating than the second hardness. The bucket opposing face 86 is readily damaged from wear and tear by boulders, such as boulders having quartz therein. The platform or plane having the first hardness, and formed of the hardened tips 125, is minimally damaged from wear and tear by boulders, such as by boulders having quartz therein.

A frame of the thumb 20 includes side support member 58, proximal support member 60, intermediate support member 62, intermediate support member 64, distal support member 66, female tooth mounts 66, proximal end 72, distal end 74, bucket opposing edge 76, stick opposing edge 78, outer face 80, inner face 82, tip 84, bucket opposing face 86, stick opposing face 88, outer plate 96, inner plate 98. This thumb frame is preferably formed of a steel such as a hardened steel having a degree of hardness on the Mohs scale of hardness from about 7.0 to about 8.0

The female tooth mounts or tooth receptors 68 are formed of steel, such as a hardened steel having a degree of hardness on the Mohs scale of hardness from about 7.0 to about 8.0.

The body of each of the teeth 70 is formed of steel, such as a hardened steel having a degree of hardness on the Mohs scale of hardness from about 7.0 to about 8.0. The body of each of the teeth 70 is the tooth without the hardened tip 125, where the hardened tip 125 includes tapering region 126 and apex 128. The body of each of the teeth 70 includes portions 116, 118, 120, 122, and 124 and further includes a portion of the body extending from portion 116 to end 110 and being received within the retainer of portion 112. The retainer of portion 112 may be formed of hardened steel.

The tooth 70 includes the hard tip 125, the monolithic tooth body, the washer 114, and the retainer. This tooth 70 is a consumable component of the thumb 20. As shown in FIG. 5B, the hard tip 125 and portions of the tooth body, such as portions 120, 122, and 124, may wear away with use, such as by making contact with massive stone boulders. At some point in the life of the tooth 70, the worn tooth 70 as shown in FIG. 5B is replaced with a fresh or new or nonworn tooth 70 shown in FIG. 5A. If desired, only the hardened tip 125 may be replaced, such as when the remainder of the tooth 70 is not worn down or damaged. The provision of a spacing between portions 116 and 120, by the inclusion of portion 118 having a relatively small diameter, provides a visual aid as to the amount of wear of portion 120 and portions axially forward of portion 120. As to tooth 70, including the hard tip 125, the steel tooth monolithic body, and the retainer, the Massa et al. U.S. Pat. No. 5,324,098 issued Jun. 28, 1994 and entitled Cutting Tool Having Hard Tip With Lobes is hereby incorporated by reference in its entirety.

Figure 6A:
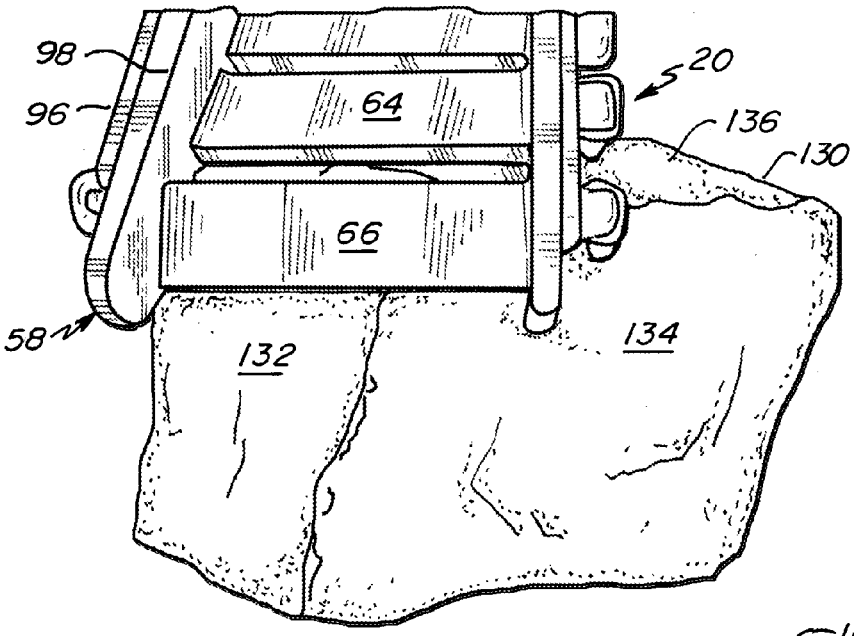
FIG. 6A shows a portion of the distal end of the thumb of FIG. 1 engaging a relatively massive stone block.

FIG. 6A shows the thumb 20 of FIG. 1 engaging a point of a stone block 130. Stone block 130 includes six sides. Three of such sides, enumerated as reference numerals 132, 134, and 136 form a tip or apex that can be readily engaged by oblique distal cross support 64 and its adjacent cross support 64. Bucket opposing face 86 of cross support member 66 extends obliquely relative to bucket opposing face 86 of cross support member 64 and this oblique relationship, coupled with the space between cross support members 64, 66, can catch the apex of sides 132, 134 and 136 of stone 130.

Figure 6B:
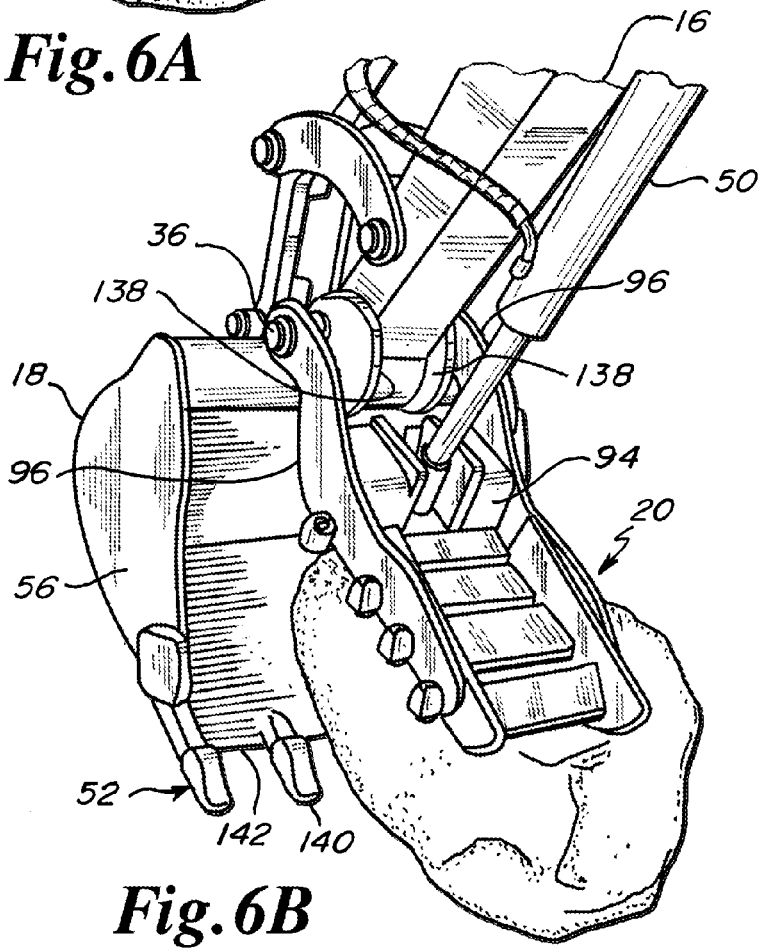
FIG. 6B shows the thumb of FIG. 1 engaging a relatively massive boulder by each of the proximal and distal ends of the thumb.

FIG. 6B shows the relative widths of the thumb 20 and bucket 18. Plates 96, or side support members 58, define a lateral width of the thumb 20 and such lateral width is less than the distance between side walls 56 of bucket 18. The width of the thumb 20 may be in the range from about 10% of the width of the bucket 18 to about 125% the width of the bucket 18, preferably about 10% to about 100% the width of the bucket 18, and most preferably about 10% to about 90% the width of the bucket 18 such that, most preferably, the width of the thumb 20 is less than the width of the bucket 18.

FIG. 6B further shows that the bucket 18 includes a pair of integral flanges 138 that are rigid with the bucket 18. Junction 36 engages these flanges 138 and further engages the proximal ends of the plates 96 and the distal end of the stick 16.

FIG. 6B further shows that the distal digging end 52 of the bucket 18 includes a set of spaced apart digging teeth 140 extending laterally from bucket side wall 56 (or end wall 56) to the other bucket side wall 56 (end wall 56). Digging teeth 140 extend longitudinally from a straight digging edge 142 that extends to and between spaced apart walls 56 and that is interrupted by the protrusion of the digging teeth 140. Teeth 140 are tapered from their proximal portions adjacent edge 142 to their distal portions or tips that are distal from digging edge 142.

Teeth 140, including the tips of the teeth 140, define a straight line in the lateral direction. This straight line is parallel to the axis of junction 36. Thumb 20 pivots on the axis of junction 36. Bucket 18 pivots on the axis of junction 36. The distal end of the stick 16 pivots on the axis of junction 36. Side support member 58, including plate 96, runs in a longitudinal direction that is normal or perpendicular to the lateral direction of bucket teeth 140 and junction 36. Thumb teeth 70 are engaged in receptacles 68 that are welded to side support member 58. There are two sets of thumb teeth 70. A first set of thumb teeth 70 are mounted in receptacles 68 on one side support member 58. A second set of thumb teeth 70 are mounted in receptacles on the other side support member 58. Each of the first and second sets of the hardened tips 125 (specifically the points of apices 128) of teeth 70 form a straight line that is normal or perpendicular to a laterally extending straight line that is parallel to lateral axis or junction 36 and that is further parallel to the straight line on which the points or tips of bucket teeth 140 are set.

FIG. 6B further shows the linear actuator connection 94 that is also seen in FIG. 4B. Specifically, connection 94 is the connection between the thumb 20 and the piston of the linear actuator 50.

In operation, the hydraulic excavator 10 is driven to a location adjacent to a massive rock such as stone block 23 shown in FIG. 1. Then, prior to picking up the stone block 23, either the thumb 20 or bucket 18, or both, may turn the stone block 23 on another of its sides or manipulate the stone block 23 in another manner while the stone block 23 is still on the ground. Then, if not yet open relative to one another, the thumb 20 and bucket 18 are opened relative to each other. Then the distal digging end 52 is slid under an edge or side of the stone block. Then the thumb 20 is swung toward the bucket 18 so as to pinch the stone block 23 between the thumb 20 and the bucket 18. As to one jaw (i.e., the thumb 20), one or more hardened tips 125 may alone make contact with the stone block 23, or portions of the frame of the thumb 20 (without the hardened tips 125) may alone make contact with the stone block 23, or a combination of one or more hardened tips 125 and portions of the frame of the thumb 20 may make contact with the stone block 23. As to the other jaw (i.e., the bucket 18), the distal digging edge 52 (either or both of the teeth 140 or cutting edge 142), or thumb opposing edges of the sidewalls 56, or a bucket surface within the bucket opening 54 or some combination of the distal digging edge 52, the thumb opposing edges of the sidewalls 56, and an interior bucket surface may make contact with the stone block 23. If the hardened tips 125 engage the stone block 23, one to eight of the hardened tips 125 may engage the stone block 23, one to four hardened tips 125 on one side support member 58 only may engage the stone block 23, or some combination of one to eight of the hardened tips 125 involving hardened tips 125 on one or both side support members 58 may engage the stone block 23. Then the hydraulic excavator 10 picks up the stone block 23. Then, if desired, the bucket 18 may be turned up and the thumb 20 may be drawn away from the bucket 18 so as to permit the stone block 23 under the force of gravity to slide deeper into the generally V-shape or U-shape of the jawed connection between the thumb 20 and the bucket 18. Then the thumb 20 may be operated so as to again pinch the stone block 23 between the thumb 20 and the bucket 18. Then the hydraulic excavator 23 is driven a distance to, for example, the final resting place of the stone block 23. This route may be flat and straight or hilly and tortuous. When the final resting place is reached, the train of the hydraulic excavator is operated to set the stone block 23 down as close to the final resting place as possible. Then the thumb 20 is drawn away from the bucket 18 and the distal digging end 52 is slid out from underneath of the edge or side of the stone block 23. Then, one or more of the thumb 20 and bucket 18 may push or turn the stone block 23 to set the stone block 23 into its final resting place.

Figure 7A:
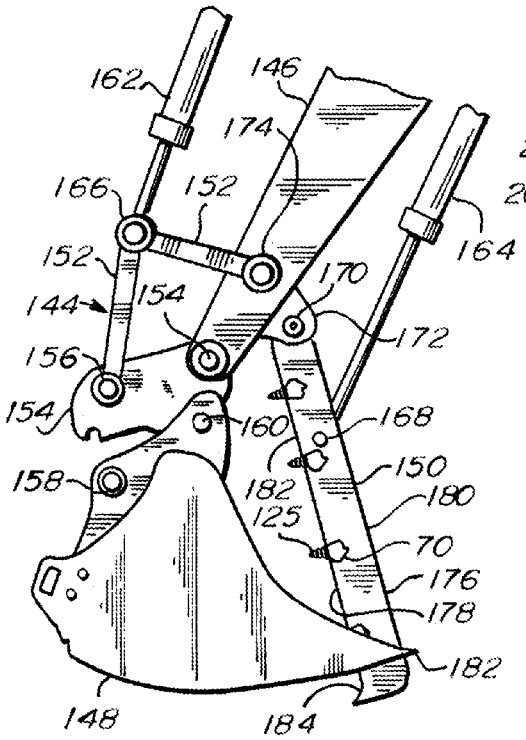
FIG. 7A shows an alternate embodiment of the thumb of FIG. 1 and an alternate excavator train.

FIG. 7A shows a hydraulic excavator apparatus 144 having a stick 146, an excavating bucket 148, a toothed thumb 150 of the present invention, a linkage 152, and a quick coupler 154. As to the quick coupler 154, the Miller et al. U.S. Pat. No. 7,984,576 B2 issued Jul. 26, 2011 and entitled Coupler is hereby incorporated by reference in its entirety.

Bucket 148 swings relative to the stick 146 through a first junction 154 and through a second junction 156. Quick coupler 154 fixedly engages pins 158, 160 of the bucket 148. Bucket 148 does not rotate relative to pins 158, 160. Bucket 148 rotates relative to junctions 154, 156. A piston of a hydraulic cylinder 162 engages linkage 152 at a junction 166. A piston of a hydraulic cylinder 164 engages thumb 150 at a junction 168. Thumb 150 engages stick 146 through a junction 170 found on a metal plate support 172. Linkage 152 is pivotally engaged to the stick 146 at a junction 174.

Thumb 150 pivots on a junction 172 having a first or thumb or lateral axis. This first thumb lateral axis is parallel to a second axis of junction 154 about which bucket 148 effectively pivots through quick coupler 154. The first or thumb axis is further parallel to a third axis of junction 156 about which bucket 148 effectively pivots through quick coupler 154. The first or thumb axis is parallel to a fourth axis of junction 166 of the linkage 152. The first or thumb axis is parallel to a fifth axis of junction 174 about which the linkage 152 rotates.

Thumb 150 includes a first side support plate or tine 176 and a second side support plate or tine 176 identical to first side support plate or tine 176. The second side support plate 176 is hidden from view in FIG. 7A. Each of the side support plates 176 includes a set of four teeth 70, where each of the teeth 70 includes a hardened tip 125. Thumb 150 includes bucket opposing face 178 and a stick opposing face 180. Bucket 148 includes a plurality of teeth 182 extending in the lateral direction. Distal ends of plates 176 are receivable between bucket teeth 182. Tooth receptors 68 are welded to the outer sides or faces of tines 176.

Hardened tips 125 of teeth 70 of thumb 150 define a first plane or first platform spaced from bucket opposing face 178. Each of the eight hardened tips 125 lie in, or define, this first plane or first platform. Four of the teeth 70 lie on a proximal portion of the thumb 150. Fourth of the teeth 70 are engaged to a distal portion of the thumb 150. This first plane or platform extends parallel to, and is spaced apart from, straight bucket opposing edge portions 182 of side support plates 176. Straight bucket opposing edge portion 182 runs from an integral tooth 184 of plate 176 to the proximal end of the plate 176 where the plate 176 engages junction 170. Each set of four teeth 70 of each side support plate or tine 176 is set on a straight line that runs normal to a lateral straight line that is parallel to the thumb axis 170 and is further parallel to a straight line defined by the tips of the bucket teeth 182.

As shown in FIG. 7A, the most proximal tooth 70 of one side plate 176 opposes the quick coupler 154 and the quick coupler/stick junction 154. The most distal tooth 70 of one side plate 176 opposes the bucket teeth 182 of the bucket digging edge. The intermediate two teeth 70 of one side plate 176 oppose the opening of the bucket 148.

The frame of thumb 150 includes the support plates or tines 176 and any cross support members therebetween. This frame is formed of hardened steel and has a first hardness. Tooth receptor 68 of thumb 150 is formed of hardened steel. Tooth 70 of thumb 150, except for hardened tip 125, is formed of hardened steel and further has this first hardness. Hardened tip 125 of thumb 150 will scratch the frame of thumb 150. The second hardness of hardened tip 125 of thumb 150 is greater than the first hardness of the thumb 150.

Figure 7B:
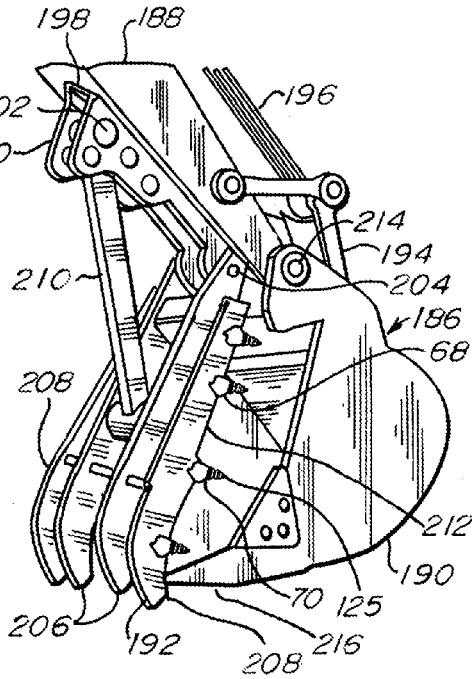
FIG. 7B shows an alternate embodiment of the thumb of FIG. 1 and an alternate excavator train.

FIG. 7B shows a mechanical excavator apparatus 186 having a stick 188, an excavating bucket 190, a toothed thumb 192 of the present invention, and a linkage 194. Apparatus 186 shows a stationary or fixed or mechanical thumb 192. Instead of being engaged to a hydraulic cylinder, linkage 194 is engaged to and controlled by cables 196.

Thumb 192 is rigid relative to the stick 188 when the hydraulic excavator is in operation. Between operations such as picking and carrying large boulders or stone blocks, thumb 192 may be rotated to another orientation. Thumb 192 includes a back plate 198 that is rigidly affixed, such as by welding, to the dipper or excavator stick 188. At the upper or distal end, back plate 198 includes a pair of support brackets 200 having a set of pin receiving openings 202. At the lower or proximal end, back plate 198 includes a pivotable junction 204. Junction 204 is engaged to the proximal end of two inner side plates 206. Inner side plates 206 extend in the longitudinal direction and are soon accompanied by two outer side plates 208. Outer side plates 208 are rigidly fixed to their adjacent inner side plates 206 by proximal and distal cross members. Inner side plates 206 are rigidly fixed to each other by proximal and distal cross members. Plates 206, 208 run parallel to each of the other plates 206, 208 such that all four plates 206, 208 run parallel to each other.

A brace arm 210 is engaged between the plates 206, 208 and the back plate 198. Specifically, one end of brace arm 210 is rotatably pinned between inner support plates 206. The other end of brace arm 210 is pinned to back plate 198 using one of the pin receiving openings 202. Depending upon the opening 202 that is used, and depending upon the length of the specific brace arm that is used, the side plates 206, 208 may extend at generally a right angle relative to stick 188, or at an acute angle relative to stick 188, or at an obtuse angle relative to stick 188.

Thumb 192 includes the female tooth receptors or mounts 68, teeth 70 and hardened tips 125. Specifically, receptors 68 are welded to outer sides or faces of outer tines 208. If desired, four tooth receptors 68 may be mounted on each of the inner tines 206.

From FIG. 7B, it can be appreciated that the four teeth hardened tips 125 do not lie in a plane by themselves or with the four hardened tips 125 of the other outside tine 208. However, such eight hardened tips 125 do define a platform spaced from a bucket opposing face 212. This platform generally follows the peaks and valleys of the bucket opposing face 212. The bucket opposing face 212 is defined by the bucket opposing edges of the tines 206, 208. Distal portions of the tines 206, 208 have a relatively great width, i.e., extend a relatively great distance from stick opposing edges to the bucket opposing edges. Proximal portions of the tines 206, 208 have a relatively narrow width, i.e., extend a relatively short distance from stick opposing edges to the bucket opposing edges. Bucket opposing edges of the tines 206, 208 that are located distally curve in a direction away from the stick opposing face of tines 206, 208. Distal opposing edges of the tines 206, 208 that are located distally curve in a direction toward the bucket opposing face of tines 206, 208.

From FIG. 7B, it can be appreciated that the two most proximal hardened tips 125 (one on each of the outer tines 208) lie in a common plane with the two most distal hardened tips 125 (one on each of the outer tines 208). This plane is spaced from all portions of the bucket opposing face 212.

Any two of the hardened tips 125 of thumb 192 define a straight line that runs normal to a laterally extending line that lies parallel to the lateral axis defined by junction 204 and that further lies parallel to a straight line defined by the absolute distal ends of a bucket digging edge 216.

All eight of the hardened tips 125 of thumb 192 define a platform that is spaced from adjacent portions of the bucket opposing face 212.

Bucket 190 pivots relative to stick 188 through a junction 214. The axis of junction 214 is parallel to the axis of junction 204.

The proximal teeth 70 of the tines 206, 208 are adjacent to or oppose bucket/stick junction 214 and are further adjacent to thumb/stick (or thumb/back plate) junction 204. The distally located teeth 70 are adjacent to or oppose the bucket digging edge 216 when the bucket 190 is swung to oppose the tines 206, 208.

The frame of thumb 192 includes the support plates or tines 206, 208 and the cross support members. This frame is formed of hardened steel. Tooth receptor 68 of thumb 192 is formed of hardened steel. Tooth 70 of thumb 192, except for hardened tip 125, is formed of hardened steel. Hardened tip 125 of thumb 192 will scratch the frame of thumb 192. Hardened tip 125 has a first hardness and the frame of thumb 192 includes a second hardness. This first hardness is greater than the second hardness.

Figure 7C:
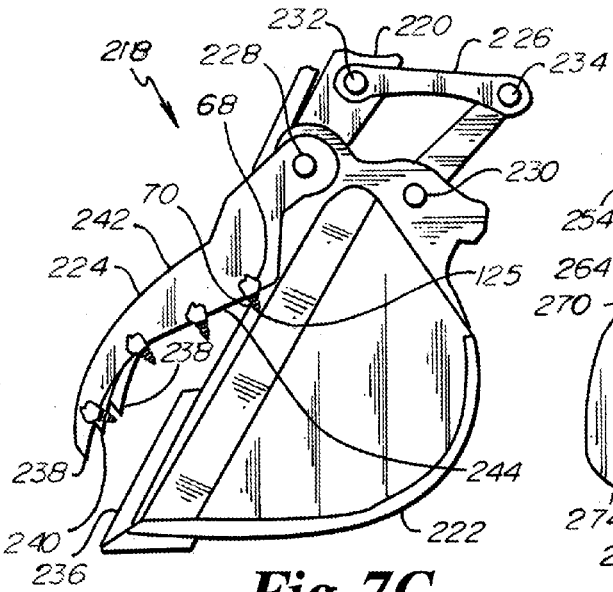
FIG. 7C shows an alternate embodiment of the thumb of FIG. 1 and an alternate bucket configuration.

FIG. 7C shows a hydraulic excavator apparatus 218 having a stick 220, an excavating bucket 222, a toothed thumb 224 of the present invention, and a linkage 226. Apparatus 218 further includes a pivoting thumb/stick/bucket junction 228, a pivoting bucket/linkage junction 230, a pivoting linkage/stick junction 232, and a pivoting linkage/linkage junction 234. A piston of a hydraulic cylinder for operating the bucket 222 is engaged to linkage/linkage junction 234. A piston 236 of a hydraulic cylinder for operating the thumb 224 is connected to a proximal portion of the thumb 224 as shown in FIG. 7C.

Bucket 222 has a nontoothed straight tapered digging edge 236 extending in a lateral direction.

Thumb 224 has two outer tines 238 and an inner tine 240. The three tines 238, 240 are parallel to each other. Each of the tines 238, 240 include stick opposing edges 242 and bucket opposing edges 244. Beginning at the proximal end of the tines 238, 240 at junction 228, the stick and bucket opposing edges 242, 244, run parallel to each other, then the edges 242, 244 run in a direction away from stick opposing edges 242, and then the edges 242, 244 begin to taper toward each other and at the same time curve away from the stick opposing edge 242. The tapering ends with the edges 242, 244 meet at a sharp distal point. Along the tapering portion, stick opposing edge 242 is convex and bucket opposing edge 244 is concave.

Thumb 218 includes the tooth receptors 68, replaceable teeth 70, and hardened tips 125. The tooth receptors 68 are welded to the outer sides of the outer tines 238 such that the absolute apices of hardened tips 125 follow the concave curvature of the bucket opposing edge 244 such that the hardened tips 125 form a hardened platform that follows the concave curvature of the bucket opposing edges 244 of the outer tines 238. This hardened platform then is spaced from all adjacent portions of the bucket opposing edges 244.

From FIG. 7C, it can be appreciated that any two hardened tips 125 on one outer tine 238 and any one hardened tip 125 on the other outer tine 238 form a plane that is spaced from their respective adjacent portions on the bucket opposing face of thumb 218 and that is further spaced from a great portion of the bucket opposing surface 244.

From FIG. 7C, it can be appreciated that the two proximal most hardened tips in combination with the two distal most hardened tips 125 define a plane that is spaced from their adjacent respective portions of the bucket opposing surface or face 244 of thumb 218 and that is further spaced from all of the bucket opposing surface 244 except a small portion of the distal end of the tines 238, 240.

From FIG. 7C, it can be appreciated that any two hardened tips 125 on a single tine 238 or 240 forms a straight line that is normal to a lateral line that is parallel to the lateral axis of junction 228 and that is further parallel to a straight line defined by straight digging lateral edge 236 of bucket 222.

From FIG. 7C, it can be appreciated that the distal most hardened tips 125 lie adjacent to and oppose the straight cutting edge 236 of bucket 222 when the bucket 222 and thumb 224 swing together. In this swung together position, the proximal most hardened tips 125 are disposed at a proximal portion of the longitudinal length of the opening of the bucket 222. In other words, the bucket 222 has an opening that has a longitudinal length. One half of this longitudinal length is a proximal portion. One half of this longitudinal length is a distal portion. The proximal most hardened tips 125 oppose the proximal portion of the longitudinal length of the opening of the bucket 222 when the bucket 222 and thumb 224 are swung together. The distal most hardened tips 125 oppose the distal portion of the longitudinal length of the opening of the bucket 222 when the bucket 222 and thumb 224 are swung together.

The frame of thumb 224 includes the tines 238, 240 and any cross support members. This frame is formed of hardened steel. Tooth receptor 68 of thumb 224 is formed of hardened steel. Tooth 70 of thumb 224, except for hardened tip 125, is formed of hardened steel. Hardened tip 125 of thumb 224 will scratch the frame of thumb 224. Hardened tips 125 of thumb 224 have a first hardness and the frame of thumb 224 have a second hardness. This first hardness is greater than this second hardness.

Figure 7D:
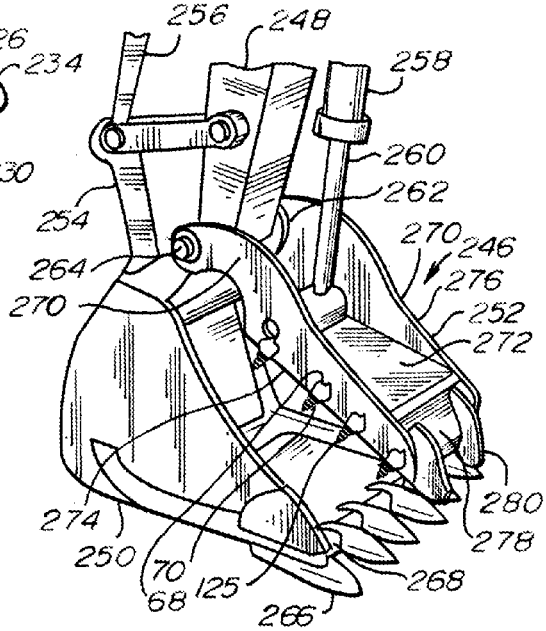
FIG. 7D shows an alternate embodiment of the thumb of FIG. 1 and an alternate bucket configuration.

FIG. 7D shows a hydraulic excavator apparatus 246 having a stick 248, an excavating bucket 250, a toothed thumb 252 of the present invention, and a linkage 254. Apparatus 246 further includes a piston 256 of a hydraulic cylinder for operating the bucket 250 and a hydraulic cylinder 258 having a piston 260 engaged to the thumb 252. Bucket 250 includes a pair of support plate ears 262 for engaging a stick junction 264 about which the bucket 250 and thumb 252 swing. Junction 264 includes a pin that engages each of the bucket 250, thumb 252, and distal end of the stick 248. Bucket 250 includes a digging teeth 266 extending from a digging edge 268 of the bucket 250. Digging edge 268 extends in the lateral direction. The tips of digging teeth 266 lie on a straight line that extends in the lateral direction.

Thumb 252 includes a frame that includes a pair of side support plates 270 that extend in the longitudinal direction from junction 264 and a proximal end of the thumb 252 to a distal end of the thumb 252. The proximal end of side support plate 270 includes a C-shaped portion. A cross support plate 272 extends in a lateral direction to and between the side support plates 270. The cross support plate 272 extends in the longitudinal direction from bucket opposing edges 274 of side support plates 270 to the stick opposing edges 276 of side support plates 270. Thumb 252 includes a distal cross plate 278 extending between the side support plates 270. Distal teeth 280, in the form of plates, extend further in the distal direction from the distal cross plate 278.

Thumb 252 includes tooth receptacles 68 and teeth 70 having hardened tips 125. Tooth receptacles 68 are welded to the outer side faces of side support plates 270. Teeth 70 extend in the direction from the stick opposing edges 276 to the bucket opposing edges 274 of side support plates 270. The hardened tips 125 of thumb 252 define a plane or platform spaced from the bucket opposing face or bucket opposing edges 274. Bucket opposing edge 274 includes a straight portion between the C-shaped proximal end of the side support plate 270 and the distal teeth 280. Teeth 70 extend from this straight portion. All eight hardened tips 125 of thumb 252 lie on the plane or platform that is spaced from the straight portions of bucket opposing edge 274 and this plane or platform is further spaced from all other portions of bucket opposing edge 274 and from the distal teeth 280. All four hardened tips 125 of each of the side support plates 270 lie on a straight line that is normal to a straight line that runs parallel to laterally extending thumb axis or junction 264, that further runs parallel to the laterally disposed bucket digging edge 268, and that further runs parallel to a lateral straight line defined by the tips of bucket teeth 266. Bucket opposing edges 274 define a bucket opposing face of thumb 252. Stick opposing edges 276 define a stick opposing face of thumb 252.

Thumb 252 has a longitudinal length. One-half of the length of thumb 252 defines a proximal portion. The other one-half of the thumb 252 defines a distal portion. Two teeth 70 (one on each of the side plates 270) lie within the proximal portion of thumb 252. Six teeth 70 (three on each of the side plates 270) lie within the distal portion of thumb 252. The distal most teeth 70 of thumb 252 (one on each of the side support plates 270) oppose the digging edge 268 and digging teeth 266 of bucket 250.

The frame of thumb 252 includes the side support plates 270, cross plate 272, cross plate 278, and distal teeth 280. This frame is formed of hardened steel. Tooth receptor 68 of thumb 252 is formed of hardened steel. Tooth 70 of thumb 252, except for hardened tip 125, is formed of hardened steel. Hardened tip 125 of thumb 252 will scratch the frame of thumb 252. The hardened tips 125 have a first hardness. The frame of thumb 252 has a second hardness. The first hardness is greater than the second hardness.

The Mohs scale of hardness is a scale of relative hardness. Some materials or minerals have the following values (or hardness rating or degree of hardness) on the Mohs scale of hardness, where the Mohs value is found in parenthesis: lead (1.5), tin (1.5), zinc (2.5), gold (2.5-3.0), silver (2.5-3.0), aluminum 2.5-3.0), copper (3.0), brass (3.0), bronze (3.0), nickel (4.0), platinum (4.0-4.5), steel (4.0-4.5), iron (4.5), palladium (4.75), glass (5.5), steel knife blade (5.5), rhodium (6.0), titanium (6.0), potassium feldspar (6.0), steel file (6.5), quartz (7.0), hardened steel (7.0-8.0), tungsten (7.5), tungsten carbide (8.5-9.0), and diamond (10.0).

The frames of the present thumbs 20, 150, 192, 224, 252, excluding the hardened tips 125, are formed of hardened steel. Depending upon the type of hardened steel, the frames of these thumbs have a hardness on the Mohs scale somewhere from about 7.0 to about 8.0. This range of hardness overlaps with the Mohs hardness value of 7.0 for quartz. Quartz is a mineral found in boulders, stone blocks, and rocks. One type of boulder, stone block or rock that includes quartz is granite. Thus it can be appreciated that the bucket opposing faces and other portions of the frames of the present thumbs 20, 150, 192, 224, and 252 are subject to wear and tear. In fact, thumbs formed of hardened steel are replaced often where the thumb, absent the teeth 70 having the hardened tip 125, are used in the business of picking up and carrying massive stone boulders. Replacement of a thumb is relatively expensive. Replacement of teeth 70 having hardened tips 125 is relatively inexpensive, even where the hardened tips 125 of the teeth 70 have a Mohs hardness rating of about 8.5 to about 9.0, such as where the hardened tips 125 are formed of tungsten carbide.

The tooth receptacle or female tooth mount 68 is disposed at or slightly out of the wear and tear bucket opposing face of the thumbs 20, 150, 192, 224, and 252. Thumb 20 is shown in FIGS. 1, 2A, 2B, 3A, 3B, 4A, 4B, 4C, 4D, 6A and 6B. Thumb 150 is shown in FIG. 7A. Thumb 192 is shown in FIG. 7B. Thumb 224 is shown in FIG. 7C. Thumb 252 is shown in FIG. 7D. In other words, the tooth receptacle 68 can be disposed such that the end 100 or annular mount 104 is disposed between the bucket opposing face of the thumb and the stick opposing face of the thumb. This position for the end 100 or annular mount 104 takes the entire tooth receptacle 68 out of the wear and tear bucket opposing face of the thumb. This position for the end 100 or annular mount 104 makes it possible to convert the thumb from a thumb having teeth with hardened tips to a thumb having another bucket opposing face, where such other bucket opposing face has a different bucket opposing face, and where such different bucket opposing face may have another type of teeth or less teeth, or where such different face may be smooth, roughened, or flat. Such different bucket opposing face may be where a number of teeth 70 are removed to, for example, provide relatively more teeth on the proximal portion of the thumb or provide relatively more teeth on the distal portion of the thumb.

Thumbs 20, 150, 192, 224, and 252 and other like thumbs can have a number of material handling or grab and pick up applications. These applications include a) picking up, carrying, and depositing massive rocks such as boulders and stone blocks, b) demolition of buildings, c) demolition of concrete, d) removing concrete and other massive objects from structures that have been demolished, e) picking up and carrying logs, timber, trees and stumps, and f) picking out, picking up and carrying sidewalk slabs. Thumbs 20, 150, 192, 224, and 252 work in these applications and, at the same time, teeth 70 preserve the bodies of the thumbs, including the bucket opposing faces of the thumbs. Many of these applications involve handling massive abrasive objects.

Massive objects can slip out of the thumb/bucket combination. With teeth 70 on each of the proximal and distal portions of the thumbs 20, 150, 192, 224 and 252, the toothed thumb can embed itself into the material being handled. Or, if the composition of the material does not lend itself to being punched, the operator of the hydraulic excavator or backhoe can look for an imperfection in the material being handled and then locate one or more teeth 70 into such imperfection where the tooth 70 will not slip out.

Some massive objects that are punched with teeth 70 may have compositions that retain their strength about the hole that is punched by a tooth 70. Other massive objects may break further along a hole that is punched and fall into or be picked up by the associated bucket.

The thumbs 20, 150, 192, 224 and 252 and other like thumbs may be utilized on relatively large or relatively small hydraulic excavators. For example, hydraulic excavators may be classified by weight. Thumbs 20, 150, 192, 224 and 252 and other like thumbs are preferred for use on hydraulic excavators weighing from 3900 pounds to 250,000 pounds, more preferred for use on hydraulic excavators weighing 5,000 pounds to 190,000 pounds, and most preferred for use on hydraulic excavators weighing 5000 to 100,000 pounds. Thumbs 20, 150, 192, 224, 252 and other like thumbs may be used on extremely large hydraulic excavators employed in mining operations that weigh about 250,000 pounds or more, including excavators that weigh as much as 2.1 million pounds.

Thumbs 20, 150, 192, 224 and 252 and other like thumbs may exert a greater pressure on the proximal end of the thumb than the distal end of the thumb. It therefore may be important, depending upon the application, to a) maximize the number of teeth on the proximal portion of the thumb and minimize the number of teeth on the distal portion of the thumb, b) minimize the number of teeth on the proximal portion of the thumb and maximize the number of teeth on the distal portion of the thumb, c) provide an equal number of teeth on the proximal and distal portions of the thumb, d) remove the teeth from one of the proximal and distal portions of the thumb and retain teeth on the other of the proximal and distal portions of the thumb, and e) remove all of the teeth from each of the proximal and distal portions of the thumb.

Thumbs 20, 150, 192, 224 and 252 and other like thumbs may include relatively few teeth or a relatively great number of teeth, depending upon the size of the thumb and the size or weight of the hydraulic excavator or backhoe. For example, thumbs 20, 150, 192, 224 and 252 and other like thumbs may have a relatively great number of teeth 70 or a relatively few number of teeth 70. For example, with a hydraulic excavator weighing about 12,000 pounds, thumbs 20, 150, 192, 224 and 252 and other like thumbs may have 2 to 50 teeth 70. Tooth receptors 68 may be disposed on the inside or outside faces of the tines of the thumbs. Tooth receptors 68 may be disposed on outside tines or on inside tines. Tooth receptors 68 may be disposed only on outside tines or only on inside tines. Tooth receptors 68 may be disposed in parallel rows and columns throughout the tines of the thumbs 20, 150, 192, 224 and 252 and other like thumbs. Tooth receptors 68 may be disposed in irregular arrangements on the proximal and distal portions of the thumbs. Teeth 70 may be engaged in some tooth receptors 68 and not others so as to provide a customized hardened tip platform for a particular unique operation or application.

Generally, teeth 70 perform two functions: 1) to protect the body or the bucket opposing face of the thumb from wear and tear and 2) to punch, grab and engage the intended object to be handled. The function of protecting against wear and tear is relatively more important with the larger machines, such as hydraulic excavators weighing about 45,000 pounds to about 100,000 pounds. The function of punching, grabbing and engaging is relatively more important with smaller machines, such as hydraulic excavators weighing about 3900 pounds to about 30,000 pounds.

Thumbs 20, 150, 192, 224 and 252 and other like thumbs can be used on heavy equipment or heavy construction equipment mobile machines such as hydraulic excavators and backhoes.

A bucket, such as bucket 18, for a heavy construction equipment mobile machine such as a hydraulic excavator or backhoe is a tool or container or scoop. Bucket 18 is a bulk material handling component. Bucket 18 has an inner volume. Bucket 18 can pick up and hold fluid or fluid like material such as sand. Bucket 18 can be a ditching bucket or trenching bucket or other type of bucket. Bucket 18 is made of steel. Bucket 18 performs a number of operations including engaging, scooping, lifting, transporting, lowering, and dumping material. As to bucket 18, the following U.S. Patent Numbers are hereby incorporated by reference in their entireties: a) the Albrecht U.S. Pat. No. 4,459,768 issued Jul. 17, 1984 and entitled Bucket Design and b) the Folkerts et al. U.S. Pat. No. 8,201,350 B2 issued Jun. 19, 2012 and entitled Machine Bucket.

It can be appreciated that thumbs 20, 150, 192, 224 and 252 include teeth 70 that sandwich the thumb frame between the teeth 70. In other words, each of these thumbs has two rows of teeth that run longitudinally from the proximal end of the thumb to the distal end of the thumb and the frame of the thumb extends between the rows of teeth. This arrangement laterally widens the effective working bucket opposing face of the thumbs since the tooth receptors 68 are welded to the outer faces of the outer tines of the thumbs. As well as widening the effective working bucket opposing face of the thumbs, the hardened teeth 70 displace the effective working bucket opposing face from the thumb frame to a platform defined by the hardened tips 125.

As shown in FIG. 4A, the platform defined by the hardened tips 125 extends laterally and longitudinally. As shown in FIG. 4A, the thumb frame of the thumb 20 includes a greatest lateral width extending laterally, where two of the hardened tips 125 are disposed laterally of each other and define a greatest laterally extending distance, and where the greatest laterally extending distance is greater than the greatest lateral width such that the thumb frame of the thumb 20 is set entirely within such two of the hardened tips 125 that define the greatest laterally extending distance. As shown in FIG. 4A, an additional tooth 70 includes a hardened tip 125 such that the thumb 20 includes first, second, third and fourth hardened tips 125 on first, second, third and fourth teeth 70, respectively. The first and second hardened tips 125 are disposed longitudinally of each other and define a first line. The third and fourth hardened tips 125 are disposed longitudinally of each other and define a second line. The thumb frame of the thumb 20 is set entirely between and is spaced apart from the first and second lines. As shown in FIG. 4A, the thumb frame of the thumb 20 includes a first tine or support plate 58. The first tine or support plate 58 is in each of the proximal and distal ends of the thumb frame of the thumb 20. The bucket opposing face 86 has a bucket opposing edge 76 on the first tine or support plate 58. A first tooth 70 of the three teeth 70 is engaged to the first tine or support plate 58 and the hardened tip 125 of the first tooth 70 is offset from the bucket opposing edge 76 of the first tine or support plate 58 in a lateral direction. A second tooth 70 of the three teeth 70 is engaged to the first tine or support plate 58 and the hardened tip 125 of the second tooth 70 is offset from the bucket opposing edge 76 of the first tine or support plate 58 in a lateral direction. As shown in FIG. 4A, the first tooth 70 is engaged to the first tine or support plate 58 in the proximal end of the thumb frame of the thumb 20 and the second tooth 70 is engaged to the first tine or support plate 58 in the distal end of the thumb frame of the thumb 20. As shown in FIG. 4A, the thumb frame of the thumb 20 includes a pair of first and second tines or support plates 58. Each of the first and second tines or support plates 58 is in each of the proximal and distal ends of the thumb frame of the thumb 20. Each of the first and second tines or support plates 58 has an outer face and an inner face. The inner faces of the first and second tines or support plates 58 face each other. The outer faces of the first and second tines or support plates 58 face away from each other. A first tooth 70 of the three teeth 70 is engaged to the first tine 10 and the hardened tip 125 of the first tooth 70 is offset from the first tine or support plate 58 in a lateral direction. A second tooth 70 of the three teeth 70 is engaged to the second tine or support plate 58 and the hardened tip 125 of the second tooth 70 is offset from the second tine or support plate 58 in a lateral direction. As shown in FIG. 4A, the first tooth 70 is engaged to the first tine or support plate 58 in the proximal end of the thumb frame of the thumb 20 and the second tooth 70 is engaged to the second tine or support plate 58 in the proximal end of the thumb frame of the thumb 20. As shown in FIG. 4A, the first tooth 70 is engaged to the first tine or support plate 58 in the distal end of the thumb frame of the thumb 20 and the second tooth 70 is engaged to the second tine or support plate 58 in the distal end of the thumb frame of the thumb 20. As shown in FIG. 4A, an additional tooth 70 includes a hardened tip 125 such that the thumb 20 includes first, second, third and fourth hardened tips 125 on first, second, third, and fourth teeth 70, respectively. Each of the first, second, third and fourth hardened tips 125 are outside of and spaced apart from the thumb frame of the thumb 20 in a lateral direction. As shown in FIG. 4C, each of said first, second, third and fourth hardened tips 125 is spaced apart from the thumb frame of the thumb 20 in a depth direction.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalents of the claims are intended to be embraced therein.

I claim:

1. A thumb for a heavy equipment vehicle, the heavy equipment vehicle having an equipment train comprising a boom, stick and bucket, the thumb opposing the bucket, the thumb comprising:

a) a thumb frame comprising:
   i) a proximal end engaged to the equipment train along a lateral axis;
   ii) a distal end;
   iii) a stick opposing face opposing the stick; and
   iv) a bucket opposing face opposing the bucket;

b) the bucket opposing face of the thumb frame comprising a material having a first degree of hardness;

c) the thumb frame comprising a longitudinal length defined by a direction from the proximal end of the thumb frame to the distal end of the thumb frame, the proximal end extending one-half the longitudinal length of the thumb frame, the distal end extending one-half the length of the thumb frame;

d) a set of four teeth being engaged to the thumb frame, each of said four teeth comprising a hardened tip;

e) one of i) said hardened tip of said tooth and ii) said tooth as a whole being individually removable from said thumb frame;

f) a platform defined by said hardened tips of said four teeth;

g) said platform extending laterally and longitudinally;

h) the platform being spaced from the bucket opposing face of the thumb frame in a depth direction;

i) each of said hardened tips having a second degree of hardness, the second degree of hardness being greater than the first degree of hardness;

j) wherein one tooth extends from said proximal end of the thumb frame, and wherein one tooth extends from the distal end of the thumb frame such that said platform extends over a portion of said proximal end of the thumb frame and such that said platform extends over a portion of said distal end of the thumb frame;

k) wherein the thumb frame comprises a first tine, the first tine extending from the proximal end to the distal end of the thumb frame, said bucket opposing face having a bucket opposing edge on said first tine, a first tooth of said four teeth being engaged to said first tine and the hardened tip of said first tooth being offset from said bucket opposing edge of the first tine in a lateral direction, and a second tooth of said four teeth being engaged to said first tine and the hardened tip of said second tooth being offset from said bucket opposing edge of the first tine in a lateral direction;

l) wherein the thumb frame further comprises a second tine, the second tine extending from the proximal end to the distal end of the thumb frame, each of said first and second tines having an outer face and an inner face, the inner faces of said first and second tines facing each other, the outer faces of said first and second tines facing away from each other, said bucket opposing face having a bucket opposing edge on said second tine, said third tooth of said four teeth being engaged to said second tine and the hardened tip of said third tooth being offset from said bucket opposing edge of the second tine in a lateral direction;

m) wherein said first tooth is engaged to the first tine in the proximal end of the thumb frame and said third tooth is engaged to the second tine in the proximal end of the thumb frame;

n) wherein said second tooth is engaged to the first tine in the distal end of the thumb frame and said fourth tooth is engaged to the second tine in the distal end of the thumb frame;

o) wherein each of said first, second, third and fourth hardened tips is spaced apart from the thumb frame in a depth direction;

p) a tooth receptacle between each of the four teeth and the thumb frame, the tooth receptacle comprising a through opening extending in a direction from the stick opposing face of the thumb frame to the bucket opposing face of the thumb frame, said opening receiving a tooth of said teeth, said tooth having an end opposite of said hardened tip, said end of said tooth being accessible through said opening such that said tooth can be punched out of the tooth receptacle in the direction from the stick opposing face of the thumb frame to the bucket opposing face of the thumb frame; and q) wherein said tooth receptacle for the first tooth is engaged to the outside face of the first tine, wherein said tooth receptacle for the second tooth is engaged to the outside face of the first tine, wherein said tooth receptacle for the third tooth is engaged to the outside face of the second tine, wherein said tooth receptacle for the fourth tooth is engaged to the outside face of the second tine.

2. The thumb of claim 1, wherein the thumb frame includes a greatest lateral width extending laterally, wherein two of said hardened tips are disposed laterally of each other and define a greatest laterally extending distance, and wherein said greatest laterally extending distance is greater than said greatest lateral width such that said thumb frame is set entirely within said two of said hardened tips that define said greatest laterally extending distance.

3. The thumb of claim 1, and said first and second hardened tips being disposed longitudinally of each other and defining a first line, said third and fourth hardened tips being disposed longitudinally of each other and defining a second line, the thumb frame being set entirely between and spaced apart from the first and second lines.

4. The thumb of claim 1, wherein said first tine comprises a first support plate.

5. The thumb of claim 1, wherein said first tine comprises a first support plate and wherein said second time comprises a second support plate.

6. The thumb of claim 1, wherein said platform comprises a planar platform.

7. The thumb of claim 1, wherein said platform comprises a concave platform.

8. The thumb of claim 1, and each of said first and second hardened tips being outside of and spaced apart from the first tine of the thumb frame in a lateral direction, each of said third and fourth hardened tips being outside of and spaced apart from the second tine of the thumb frame in a lateral direction.

* * * * *